US010716355B2

(12) United States Patent
Mallen et al.

(10) Patent No.: US 10,716,355 B2
(45) Date of Patent: Jul. 21, 2020

(54) ARTICLE OF FOOTWEAR INCORPORATING A KNITTED COMPONENT WITH DURABLE WATER REPELLANT PROPERTIES

(71) Applicant: NIKE, Inc., Beaverton, OR (US)

(72) Inventors: Sabrina P. Mallen, Portland, OR (US); Bhupesh Dua, Portland, OR (US); Erin Toraya, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/176,052

(22) Filed: Oct. 31, 2018

(65) Prior Publication Data

US 2019/0069625 A1 Mar. 7, 2019

Related U.S. Application Data

(62) Division of application No. 14/606,505, filed on Jan. 27, 2015, now Pat. No. 10,143,260.
(Continued)

(51) Int. Cl.

| | |
|---|---|
| ***A43B 1/04*** | (2006.01) |
| ***A43D 11/00*** | (2006.01) |
| ***A43B 23/00*** | (2006.01) |
| ***A43B 7/12*** | (2006.01) |
| ***A43B 23/02*** | (2006.01) |

(Continued)

(52) U.S. Cl.
CPC ..... *A43B 1/04* (2013.01); *A43B 7/12* (2013.01); *A43B 23/00* (2013.01); *A43B 23/0265* (2013.01); *A43B 23/042* (2013.01); *A43D 11/00* (2013.01); *D04B 1/12* (2013.01);
(Continued)

(58) Field of Classification Search
None
See application file for complete search history.

(56) References Cited

U.S. PATENT DOCUMENTS

| | | | |
|---|---|---|---|
| 761,520 | A | 5/1904 | Matthew |
| 3,484,881 | A | 12/1969 | Krieger |

(Continued)

FOREIGN PATENT DOCUMENTS

| | | | |
|---|---|---|---|
| CN | 101991209 | A | 3/2011 |
| CN | 102271548 | A | 12/2011 |

(Continued)

OTHER PUBLICATIONS

Office Action and English translation for corresponding Argentina Application No. P150100492, dated Jul. 12, 2019, 3 pages.

(Continued)

*Primary Examiner* — Shawn Mckinnon
(74) *Attorney, Agent, or Firm* — Brinks Gilson & Lione

(57) ABSTRACT

A knitted component for an upper of an article of footwear, a method for making the knitted component, and a method of making the article of footwear is described. The knitted component includes a first portion formed by a first yarn having durable water repellent properties and a second portion formed by a second yarn different from the first yarn. The second yarn is disposed along an edge portion of the knitted component configured to be attached to a sole structure to form an article of footwear. The knitted component is formed of unitary knit construction.

16 Claims, 23 Drawing Sheets

Related U.S. Application Data

(60) Provisional application No. 61/942,683, filed on Feb. 21, 2014.

(51) Int. Cl.
*A43B 23/04* (2006.01)
*D04H 13/00* (2006.01)
*D04B 1/12* (2006.01)

(52) U.S. Cl.
CPC ..... *D04H 13/00* (2013.01); *D10B 2401/021* (2013.01); *D10B 2403/032* (2013.01); *D10B 2501/043* (2013.01)

(56) References Cited

U.S. PATENT DOCUMENTS

| | | | | |
|---|---|---|---|---|
| 3,605,294 | A | 9/1971 | Cunningham et al. | |
| 4,899,411 | A | 2/1990 | Johnson et al. | |
| 5,271,780 | A | 12/1993 | Baigas, Jr. | |
| 5,345,638 | A | 9/1994 | Nishida | |
| 5,516,476 | A | 5/1996 | Haggard et al. | |
| 5,851,562 | A | 12/1998 | Haggard et al. | |
| 5,932,056 | A | 8/1999 | Mark | |
| 6,299,962 | B1 | 10/2001 | Davis | |
| 6,874,252 | B2 | 4/2005 | Nakano | |
| 6,931,762 | B1 | 8/2005 | Dua | |
| 7,347,011 | B2 | 3/2008 | Dua et al. | |
| 7,730,640 | B2 | 6/2010 | Clark et al. | |
| 8,490,299 | B2 | 7/2013 | Dua et al. | |
| 8,800,606 | B2 | 8/2014 | Cross et al. | |
| 8,839,532 | B2 | 9/2014 | Huffa et al. | |
| 2004/0118018 | A1 | 6/2004 | Dua | |
| 2005/0066547 | A1 | 3/2005 | Al-Rasheed | |
| 2005/0208860 | A1 | 9/2005 | Baron | |
| 2007/0245595 | A1 | 10/2007 | Chen | |
| 2008/0052957 | A1 | 3/2008 | Taheri | |
| 2008/0110048 | A1 | 5/2008 | Dua et al. | |
| 2008/0110051 | A1 | 5/2008 | Min | |
| 2008/0127426 | A1 | 6/2008 | Morlacchi et al. | |
| 2010/0011624 | A1 | 1/2010 | Polegato Moretti | |
| 2010/0115792 | A1 | 5/2010 | Muller | |
| 2010/0154256 | A1 | 6/2010 | Dua | |
| 2010/0199406 | A1 | 8/2010 | Dua | |
| 2010/0293812 | A1 | 11/2010 | Coulson | |
| 2011/0000106 | A1 | 1/2011 | Baychar | |
| 2011/0239485 | A1 | 10/2011 | Hooper et al. | |
| 2012/0023686 | A1* | 2/2012 | Huffa | A43B 23/042 12/145 |
| 2012/0030885 | A1 | 2/2012 | Moretti | |
| 2012/0073164 | A1 | 3/2012 | Linth et al. | |
| 2012/0233882 | A1* | 9/2012 | Huffa | A43B 1/04 36/45 |
| 2012/0234052 | A1 | 9/2012 | Huffa et al. | |
| 2012/0255201 | A1 | 10/2012 | Little | |
| 2013/0036628 | A1 | 2/2013 | Hussey et al. | |
| 2013/0051706 | A1 | 2/2013 | Roether et al. | |
| 2013/0059116 | A1 | 3/2013 | Peikert | |
| 2013/0186054 | A1 | 7/2013 | Dua et al. | |
| 2013/0186505 | A1 | 7/2013 | Cross et al. | |
| 2013/0186506 | A1 | 7/2013 | Cross et al. | |
| 2013/0189890 | A1 | 7/2013 | Cross et al. | |
| 2013/0190917 | A1 | 7/2013 | Cross et al. | |
| 2013/0247414 | A1 | 9/2013 | Bier | |
| 2013/0260104 | A1 | 10/2013 | Dua et al. | |
| 2014/0173933 | A1 | 6/2014 | Bell | |
| 2014/0182168 | A1 | 7/2014 | Avar et al. | |
| 2015/0237948 | A1 | 8/2015 | Mallen et al. | |

FOREIGN PATENT DOCUMENTS

| | | | |
|---|---|---|---|
| CN | 102292487 | A | 12/2011 |
| CN | 202425687 | U | 9/2012 |
| CN | 104106883 | A | 10/2014 |
| DE | 10343620 | A1 | 4/2005 |
| EP | 2649898 | | 10/2013 |
| FR | 2572426 | | 2/1986 |
| GB | 1098441 | | 10/1968 |
| GB | 2416781 | | 8/2006 |
| JP | 1056005 | | 2/1998 |
| KR | 10-1240490 | B1 | 3/2013 |
| TW | 200840500 | | 10/2008 |
| TW | M515789 | | 1/2016 |

OTHER PUBLICATIONS

Office Action and English translation of relevant portions for Chinese Application No. 2017101534531, dated Jul. 2, 2019, 6 pages.
Office Action for Sri Lanka Application No. 18938, dated Mar. 28, 2019, 1 page.
Office Action for Sri Lanka Application No. 18939, dated Mar. 26, 2018, 1 page.
Office Action and English translation for ROC (Taiwan) Application No. 104202854, dated Jul. 9, 2015, 5 pages.
Haggard, "Hills' Quick Color Change Technology", Nov. 2002, C:\Users\awilkie\AppData\Local\Microsoft\Windows\Temporary Internet Files\OLK2B69\Introduction to QCCT 2.doc Jan. 28, 2013, 4 pgs.
U.S. Appl. No. 61/745,269, filed Dec. 21, 2012.
Office Action and translated relevant portion from corresponding Chinese Application No. 201510083601.8, dated Apr. 5, 2016, 6 pages.
Notification of Transmittal of the International Search Report and the Written Opinion dated Apr. 29, 2015 in International No. PCT/US2015/014218.
International Preliminary Report on Patentability from corresponding PCT/US2015/014218, dated Aug. 23, 2016, 11 pages.
Notification of Transmittal of the International Search Report and the Written Opinion dated Apr. 29, 2015 in International No. PCT/US2015/014225.
International Preliminary Report on Patentability from PCT/US2015/014225, dated Aug. 23, 2016, 12 pages.
Office Action and English translation for ROC (Taiwan) Application No. 104105719 dated May 5, 2017, 8 pages.
Office Action and English translation for ROC (Taiwan) Application No. 104105719 dated Jan. 4, 2017, 39 pages.
Office Action and English translation for corresponding ROC (Taiwan) Application No. 104105721 dated Dec. 8, 2016, 33 pages.
Office Action and English translation for ROC (Taiwan) Application No. 104105721 dated Jun. 27, 2017, 10 pages.
Office Action and English translation for ROC (Taiwan) Application No. 104105721 dated Jan. 10, 2018, 4 pages.
Office Action and English translation for Vietnamese Application No. 1-2016-03502, dated Oct. 8, 2019, 4 pages.
Office Action and English translation for Vietnamese Application No. 1-2016-03503, dated Oct. 8, 2019, 4 pages.
Office Action and English translation of relevant portion for Chinese Application No. 2017101534531, dated Mar. 4, 2020, 10 page.

* cited by examiner

ARTICLE OF FOOTWEAR INCORPORATING A KNITTED COMPONENT WITH DURABLE WATER REPELLANT PROPERTIES

CROSS-REFERENCE TO RELATED APPLICATION

This application is a divisional application of U.S. application Ser. No. 14/606,505, filed Jan. 27, 2015, which claims the benefit of priority under 35 U.S.C. § 119(e) to U.S. Provisional Application Ser. No. 61/942,683, filed in the U.S. Patent and Trademark Office Feb. 21, 2014, which are incorporated by reference in their entireties herein.

BACKGROUND

The present disclosure relates generally to a knitted component for an article of footwear. The present disclosure also relates to an article of footwear having an upper comprising the knitted component. The present disclosure further is related generally to a method of knitting the knitted component, and to a method of making an article of footwear having an upper comprising the knitted component.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

Reducing the number of material elements may require that one material element provide multiple and additional properties and characteristics sought by users. Thus, there exists a need in the art for articles of footwear comprising a minimum number of material elements while providing a number of properties and characteristics sought by users.

SUMMARY

Various configurations of an article of footwear may have an upper and a sole structure secured to the upper. The upper may incorporate a knitted component.

In one aspect, the disclosure provides a knitted component for an upper of an article of footwear. The knitted component includes a first portion formed by a first yarn, the first yarn having durable water repellent properties. The knitted component also has a second portion formed by a second yarn. The second yarn is different from the first yarn. The second yarn is disposed along an edge portion of the knitted component configured to be attached to the sole structure. The knitted component including the first portion and the second portion is formed of unitary knit construction.

In another aspect, the disclosure comprises an article of footwear having an upper and a sole structure secured to the upper. The upper comprises a knitted component formed of unitary knit construction. The knitted component comprises a first portion formed by a first yarn having durable water repellent properties. The knitted component has a second portion formed by a second yarn, the second yarn being different from the first yarn. The second yarn is disposed along an edge portion of the knitted component configured to be attached to the sole structure.

The disclosure provides a method of knitting a knitted component for an upper of an article of footwear having an upper and a sole structure. The method includes knitting a first portion of the knitted component formed by a first yarn, the first yarn having durable water repellent properties, and knitting a second portion of the knitted component formed by a second yarn, the second yarn being different from the first yarn. The second portion is disposed along an edge portion of the knitted component and is configured to be attached to the sole structure.

The disclosure also provides a method of manufacturing an article of footwear having an upper and a sole structure. The method comprises knitting a knitted component formed of a unitary knit construction for incorporation into the upper. A first portion of the knitted component is formed by first yarn, the first yarn having durable water repellent properties. A second portion of the knitted component disposed along an edge portion of the knitted component and configured to be attached to the sole structure is formed by a second yarn. The second yarn is different from the first yarn. The sole structure is attached to the second portion of the knitted component.

Other systems, methods, features, and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
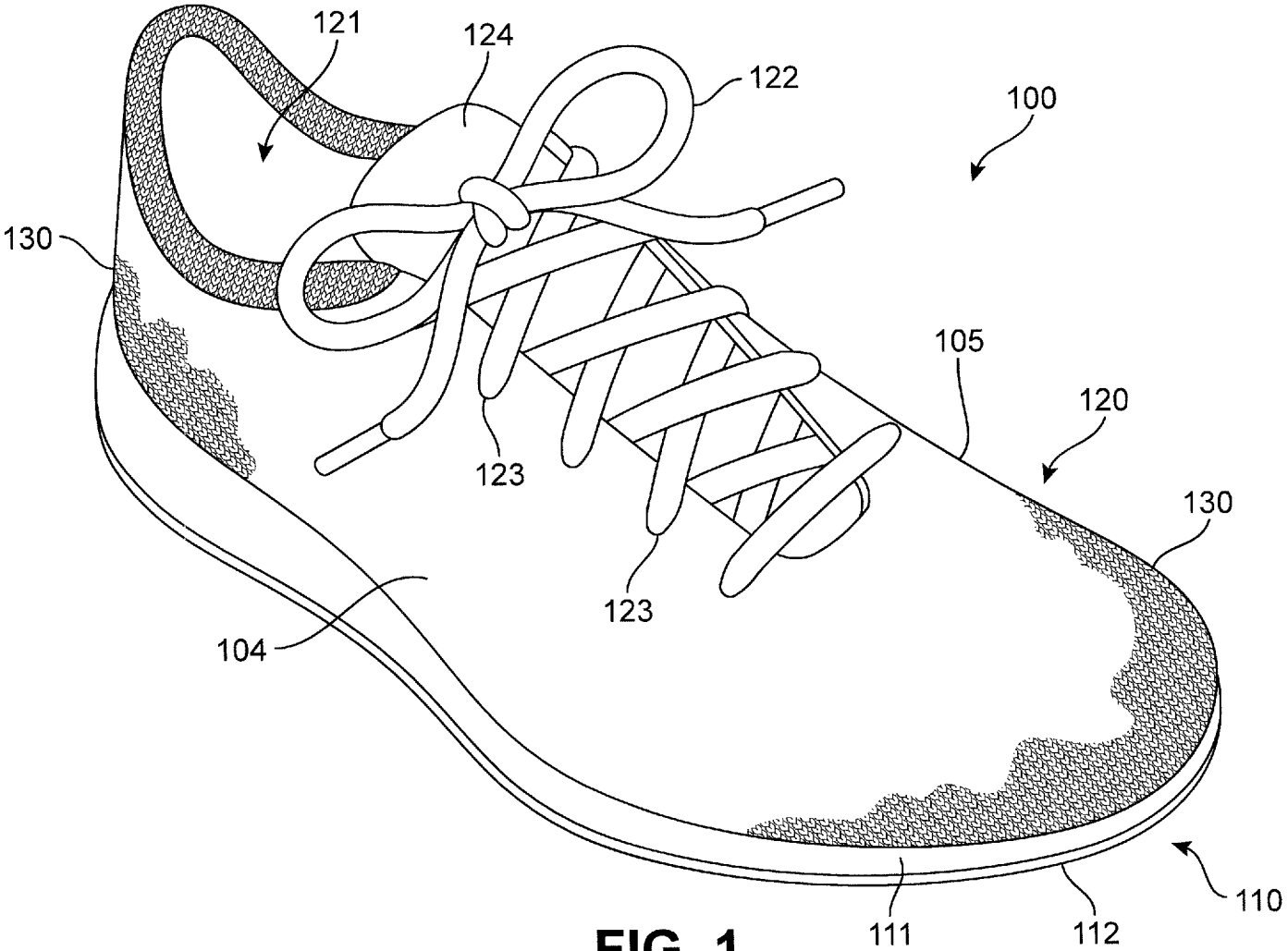
FIG. 1 is a perspective view of an exemplary embodiment of an article of footwear.

In one aspect, the disclosure provides a knitted component for an upper of an article of footwear. The knitted component includes a first portion formed by a first yarn, the first yarn having durable water repellent properties. The knitted component also has a second portion formed by a second yarn. The second yarn is different from the first yarn. The second yarn is disposed along an edge portion of the knitted component configured to be attached to the sole structure. The knitted component including the first portion and the second portion is formed of unitary knit construction.

In another aspect, the disclosure comprises an article of footwear having an upper and a sole structure secured to the upper. The upper comprises a knitted component formed of unitary knit construction. The knitted component comprises a first portion formed by a first yarn having durable water repellent properties. The knitted component has a second portion formed by a second yarn, the second yarn being different from the first yarn. The second yarn is disposed along an edge portion of the knitted component configured to be attached to the sole structure.

The disclosure provides a method of knitting a knitted component for an upper of an article of footwear having an upper and a sole structure. The method includes knitting a first portion of the knitted component formed by a first yarn, the first yarn having durable water repellent properties, and knitting a second portion of the knitted component formed by a second yarn, the second yarn being different from the first yarn. The second portion is disposed along an edge portion of the knitted component and is configured to be attached to the sole structure The disclosure also provides a method of manufacturing an article of footwear having an upper and a sole structure. The method comprises knitting a knitted component formed of a unitary knit construction for incorporation into the upper. A first portion of the knitted component is formed by first yarn, the first yarn having durable water repellent properties. A second portion of the knitted component disposed along an edge portion of the knitted component and configured to be attached to the sole structure is formed by a second yarn. The second yarn is different from the first yarn. The sole structure is attached to the second portion of the knitted component.

Although the disclosure is described in detail as it relates to a knitted component for an upper for an article of footwear, the principles described herein may be applied to any textile element to provide durable water repellant properties to a portion of an object. For example, the principles may be applied to textiles including, but not limited to, knitted textiles, woven textiles, and non-woven textiles. Knitted textiles include textiles formed by way of warp knitting, weft knitting, flat knitting, circular knitting, and other suitable knitting operations. The knit textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, and double cloth weaves, for example. Non-woven textiles include textiles made by air-laid and spun-laid methods, for example.

One property or characteristic that may be desired by wearers of footwear is resistance to incursion of water and other liquids from outside the footwear. Water can enter footwear from many places. For example, any seam might leak and allow water into the footwear. Further, water may enter through the material of construction. In particular, web materials, such as knitted, woven, and/or nonwoven fabrics, may be more porous to incursion by water then other materials such as leather or synthetic leather. In some cases, such web materials may be used to form uppers for footwear that are lightweight.

Therefore, some consumers may treat footwear having an upper comprising a web material with a water repellent or waterproof composition. Imbuing a web material with water resistance can be particularly desirable for footwear made with yarn that is highly texturized. Such highly textured yarn has a high specific surface area and may tend to adsorb more water than an un-texturized yarn unless the yarn is coated or treated with a water-repellent material.

However, this technique typically may be less than satisfactory. Such consumer-applied treatments typically are unsatisfactory as it often is difficult to apply such materials in a manner that significantly reduces water incursion. Further, application of waterproofing or water repellent compositions may tend to make the footwear uncomfortable, heavy, inflexible, and unattractive, thus defeating the purpose of using the web material.

Another way to reduce water incursion through footwear uppers having a web material is to form the upper with a water-repellent material. Water-repellent materials may complicate manufacture of the article of footwear, however, particularly at the attachment of the upper to a sole structure. Many articles of footwear, especially footwear including web materials, such as a knitted component, typically are not the sewn to the sole structure. Rather, adhesive bonding often is used to join the parts.

Footwear uppers having a component made from material that is water-repellent may, therefore, serve to reduce undesirable water incursion into the footwear. Such material can be adhered to a sole structure with a solvent-based adhesive. However, solvent-based adhesives may face governmental regulation and may require special attention in usage and handling techniques. Hence, water-based adhesives typically are used. However, the water repellent nature of a knitted component in an upper made from water-repellent yarn generally precludes use of water-based adhesives to attach the upper to a sole structure.

Embodiments of the knitted component for incorporating into an upper disclosed herein having a first portion formed by yarn having durable water repellent properties provides reduced water incursion as compared with a typical knitted component. The disclosed knitted component also provides a second portion made from a yarn different from the yarn having durable water repellent properties. The second portion is disposed along an edge of the knitted component and provides a portion suitable for use with water-based adhesives. Water-based adhesives include adhesives that are soluble in water or that are carried in water, such as a suspension or dispersion of adhesive in water. Thus, the knitted component may be incorporated into an upper that is water-repellent and an article of footwear wherein the upper may be adhered to a sole structure with water-based adhesive. The resultant article of footwear disclosed herein thus provides the properties and characteristics sought by the wearer, such as comfort, flexibility, lateness, an attractive appearance, and reduced water incursion, yet may be assembled with water-based adhesives.

In some embodiments, a third portion of the knitted component may provide an area in which water-based indicia may be applied to an area of the knitted component that is visible when the knitted component is incorporated into the upper of an article of footwear. Water-based indicia include indicia that are soluble in water or that are carried in water, such as a suspension or dispersion of indicia in water. The third portion is made from a yarn that does not have durable water repellent property.

In some embodiments, a fourth portion of the knitted component may provide an area of the knitted component that serves as a rand. A rand is an area on an upper of an article of footwear that is located vertically above the biteline where the sole structure and upper are attached. A rand may be continuous around the upper, or may be discontinuous or located only in select areas. For example, in an exemplary embodiment, a rand may extend around the outer periphery of the upper through each of the forefoot portion, the midfoot portion, and the heel portion. In other embodiments, a rand may be present only on the forefoot portion of the upper. In still other embodiments, a rand may be present on the forefoot portion and the heel portion of the upper. A rand may comprise a material that provides properties and characteristics suited for that area of the article of footwear.

In some embodiments, a rand may be an area imbued with durable water repellant properties. Typically, in such an embodiment, at least some of the area of the upper adjacent the rand may be devoid of durable water repellant properties. In other embodiments, the rand may not be imbued with durable water repellant properties, whereas at least some of the upper adjacent the rand may have durable water repellant properties. A rand not imbued with durable water repellant properties may be suitable for application of coatings and other compositions enabling the rand to provide suitable protection from abrasion.

In some embodiments, a rand may be provided by knitting the fourth portion of the knitted component with appropriate material in a band extending continuously around the perimeter of an article of footwear above the biteline. In other embodiments, a rand may extend any distance above the biteline sufficient to provide water repellency at and above the biteline. With this configuration, a rand may be provided to an area of the upper that is disposed close to the sole structure.

Additionally, in some embodiments, the fourth portion of the knitted component may be present together with the third portion, as detailed above. In other embodiments, the fourth portion may be present in the absence of the third portion.

The yarns used in embodiments of the disclosure may be selected from monofilament yarns and multifilament yarns formed from natural or synthetic materials. Multifilament yarns may be twisted or untwisted. In some embodiments, yarn may be elastic or essentially inelastic. In some embodiments, yarn may be textured or have a natural finish. Natural materials may be selected from staple materials, such as silk, cotton, and wool. Synthetic materials may be selected from polymers that can be formed into filaments. Synthetic materials include but are not limited to polyesters; polyamides, such as any of the various types of homopolymeric and co-polymeric nylon; aramides, such as Kevlar® and Nomex®; and urethanes, such as thermoplastic polyurethane.

In embodiments of the disclosure, the first yarn having durable water repellent properties may be selected from yarns that meet design criteria and may incorporate yarns with different deniers, materials (e.g., cotton, elastane, polyester, rayon, wool, and nylon), and degrees of twist, for example. The different types of yarns may affect the physical properties of a knitted component, including aesthetics, stretch, thickness, air permeability, and abrasion-resistance. That is, the different types of yarns may impart different properties to different areas of the knitted component. By combining various types and combinations of stitches and yarns, each area of knitted component may have specific properties that enhance the comfort, durability, and performance of the article of footwear. In some configurations, multiple yarns with different colors may be utilized to form the knitted component. When yarns with different colors are twisted together and then knitted, the knitted component may have a heathered appearance with multiple colors randomly distributed throughout.

In embodiments of the disclosure, the yarns may be treated with a durable water repellence-providing composition during manufacture to yield yarn having durable water repellent properties. The yarn may be made by any suitable method. For example, a durable water repellence-providing composition may be applied in a batch process, wherein untreated yarn, for example on a beam, is passed through a bath of durable water repellence-providing composition, heat treated if necessary, and then wound onto a second beam. Another batch process may include dipping the quantity of yarn into a bath of durable water repellence-providing composition. Alternatively, durable water repellence-providing composition may be applied to the surface of a resin-based yarn formed by extrusion. Typically, in such a method, resin may be extruded to form a partially-oriented yarn. Partially-oriented yarn then may be texturized. Durable water repellence-providing composition may be applied to the yarn during or after texturization. The yarn then typically may be heat-treated and prepared for knitting.

In some embodiments, a resin may be imbued with durable water repellence properties during yarn manufacture by introducing a durable water repellence-providing composition from a masterbatch. A masterbatch is a mixture of a carrier resin having a high concentration of an additive. In embodiments herein, the carrier resin is a resin used to form a yarn, and the additive is the durable water repellant composition. A selected concentration of durable water repellence-providing material then is introduced into the carrier resin. The material in the carrier resin then is introduced into the bulk of the polymeric resin. The blend then is formed into yarn.

Another suitable yarn having durable water repellent properties may be a core and sheath-type bi-component yarn having a sheath of material having durable water repellent properties essentially concentric with and surrounding a core of yarn material. Other bi-component yarns, such as "islands in the sea" type, also may be suitable. Still another technique may be to spray durable water resistant composition onto yarn.

The durable water repellence-providing composition may be any composition that repels water and that can be durably associated with a yarn. For example, the durable water repellence-providing composition may be selected from any suitable water-repellent composition, such as but not limited to C4, C6, and C8 fluorocarbons, silicones, waxes, a plasma coating, and durable water repellence-providing materials that remain bondable with adhesives. Durable water repellence-providing composition typically is heat-treated to cure the material. The heat cure may be carried out during steaming, and typically can be carried out during manufacture of the knitted component.

The following discussion and accompanying Figures disclose a variety of concepts relating to knitted components and the manufacture of knitted components. Although the knitted components may be utilized in a variety of products, an article of footwear that incorporates one of the knitted components is disclosed below as an example. The description will be directed in detail to an article of footwear. However, in addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g., bandages, swabs, and implants), geotextiles for reinforcing embankments, agro-textiles for crop protection, and industrial apparel that protects or insulates against heat and radiation. Accordingly, the knitted components and other concepts disclosed herein may be incorporated into a variety of products for both personal and industrial purposes.

Figure 2:
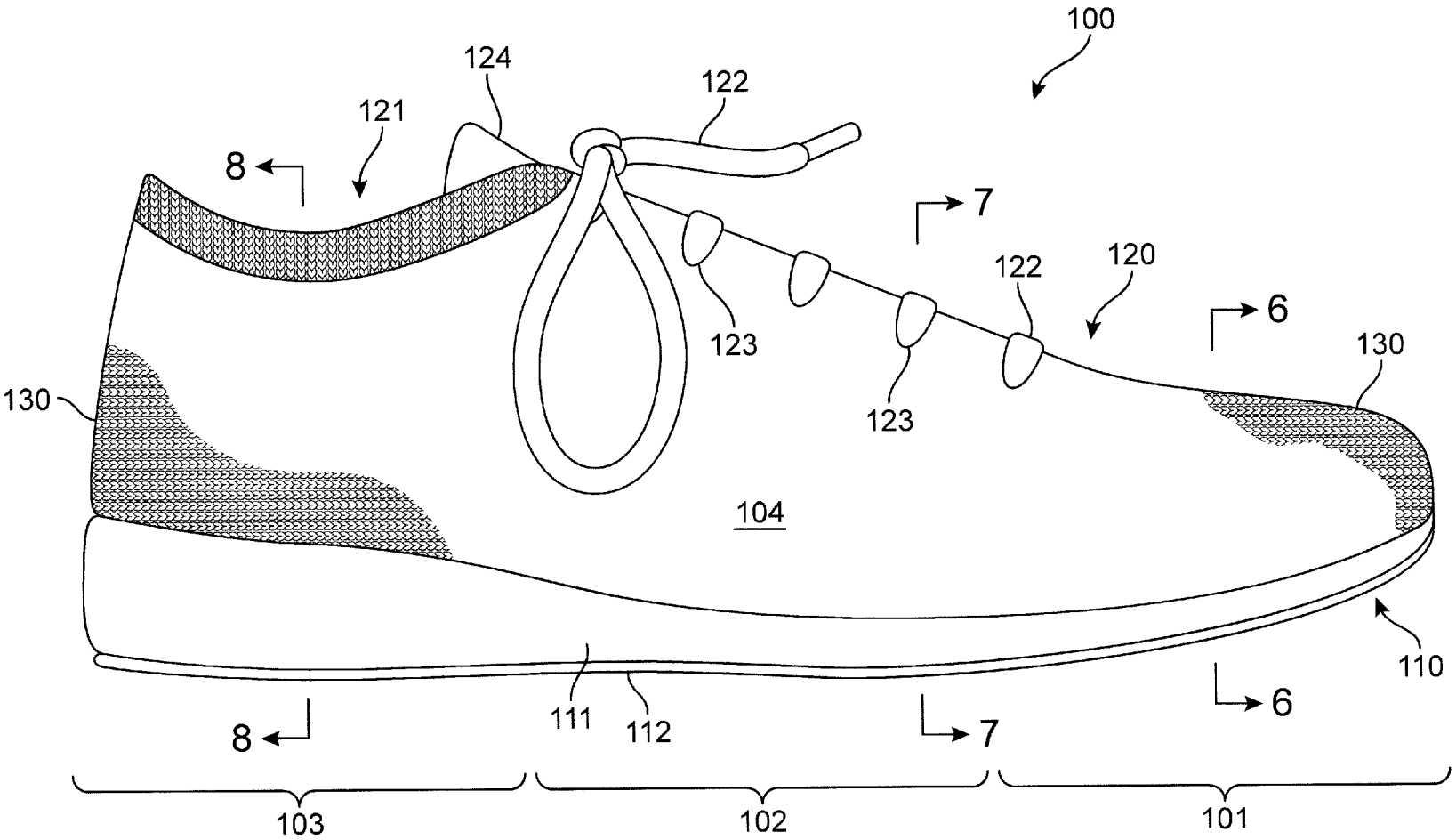
FIG. 2 is a lateral side elevational view of the exemplary embodiment of an article of footwear.
Figure 3:
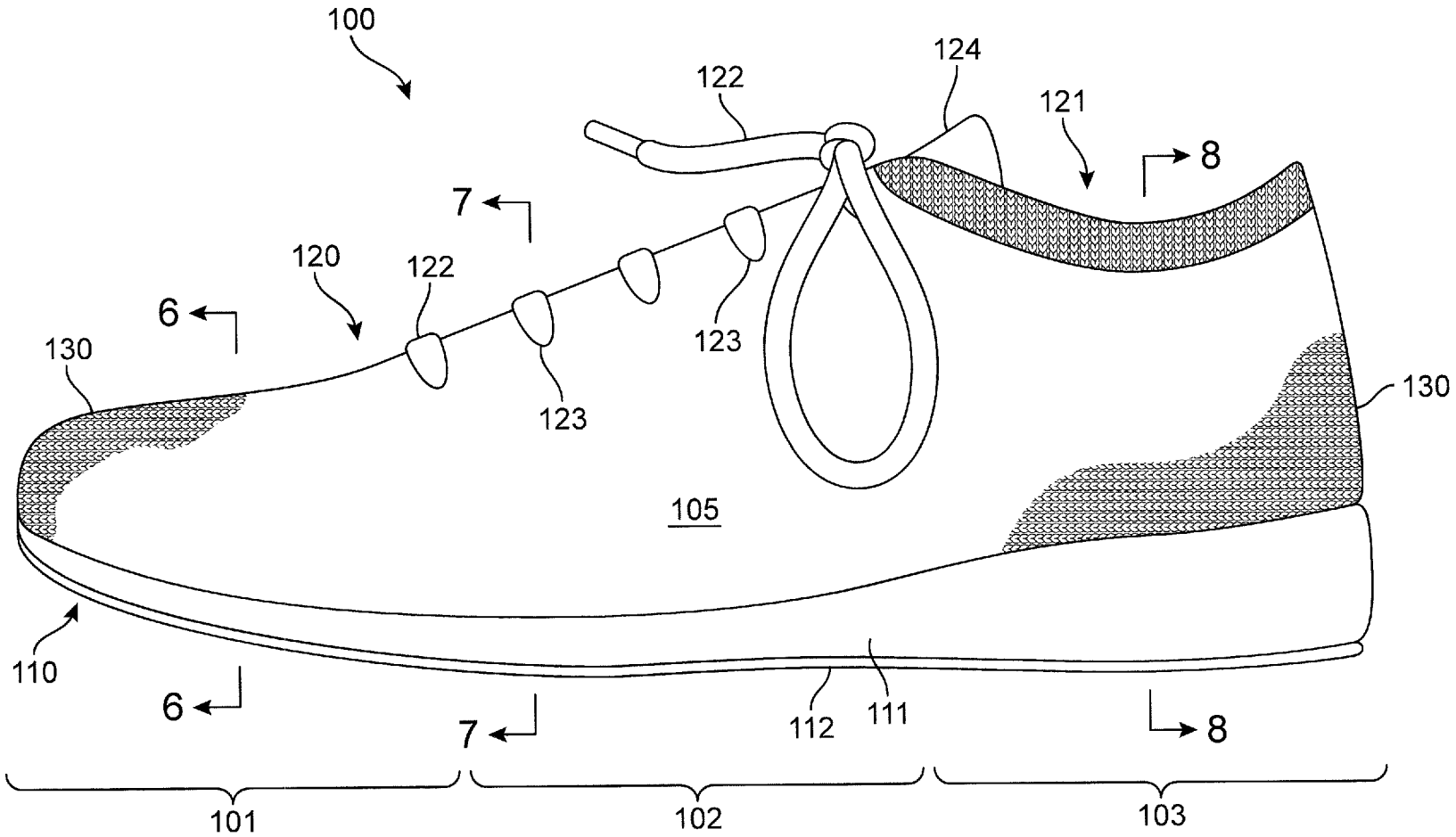
FIG. 3 is a medial side elevational view of the exemplary embodiment of an article of footwear.

An article of footwear 100 is depicted in FIGS. 1-3 as including a sole structure 110 and an upper 120. Although footwear 100 is illustrated as having a general configuration suitable for running, concepts associated with footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 apply to a wide variety of footwear types.

For reference purposes, footwear 100 may be divided into three general regions: a forefoot region 101, a midfoot region 102, and a heel region 103. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of forefoot region 101, midfoot region 102, and heel region 103 and correspond with opposite sides of footwear 100. More particularly, lateral side 104 corresponds with an outside area of the foot (i.e., the surface that faces away from the other foot), and medial side 105 corresponds with an inside area of the foot (i.e., the surface that faces toward the other foot). Forefoot region 101, midfoot region 102, heel region 103, lateral side 104, and medial side 105 are not intended to demarcate precise areas of footwear 100. Rather, forefoot region 101, midfoot region 102, heel region 103, lateral side 104, and medial side 105 are intended to represent general areas of footwear 100 to aid in the following discussion. In addition to footwear 100, forefoot region 101, midfoot region 102, heel region 103, lateral side 104, and medial side 105 may also be applied to sole structure 110, upper 120, and individual elements thereof.

Sole structure 110 is secured to upper 120 and extends between the foot and the ground when footwear 100 is worn. The primary elements of sole structure 110 are a midsole 111, an outsole 112, and a sockliner 113. Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 is secured to a lower surface of midsole 111 and may be formed from a wear-resistant rubber material that is textured to impart traction. Sockliner 113 is located within upper 120 and is positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be utilized. Accordingly, the features of sole structure 110 or any sole structure utilized with upper 120 may vary considerably.

Upper 120 defines a void within footwear 100 for receiving and securing a foot relative to sole structure 110. The void is shaped to accommodate the foot and extends along a lateral side of the foot, along a medial side of the foot, over the foot, around the heel, and under the foot. Access to the void is provided by an ankle opening 121 located in at least heel region 103. In some embodiments of the disclosure, lace 122 may extend through various lace apertures 123 in upper 120 and permits the wearer to modify dimensions of upper 120 to accommodate proportions of the foot. More particularly, lace 122, if present, permits the wearer to tighten upper 120 around the foot, and lace 122 permits the wearer to loosen upper 120 to facilitate entry and removal of the foot from the void (i.e., through ankle opening 121). Collar 143 extends around ankle opening 121. In addition, upper 120 may include a tongue 124 that extends under lace 122 and lace apertures 123 to enhance the comfort of footwear 100. In further configurations, upper 120 may include additional elements, such as (a) a heel counter in heel region 103 that enhances stability, (b) a toe guard in forefoot region 101 that is formed of a wear-resistant material, and (c) logos, trademarks, and placards with care instructions and material information.

Many conventional footwear uppers are formed from multiple material elements (e.g., textiles, polymer foam, polymer sheets, leather, and synthetic leather) that are joined through stitching or bonding, for example. In contrast, in embodiments of the disclosure, a majority of upper 120 is formed from a knitted component 130, which extends through each of forefoot region 101, midfoot region 102, and heel region 103 along both lateral side 104 and medial side 105, over forefoot region 101, and around heel region 103. In addition, knitted component 130 forms portions of both an exterior surface and an opposite interior surface of upper 120. As such, knitted component 130 defines at least a portion of the void within upper 120. In some configurations, knitted component 130 may also extend under the foot.

Figure 4:
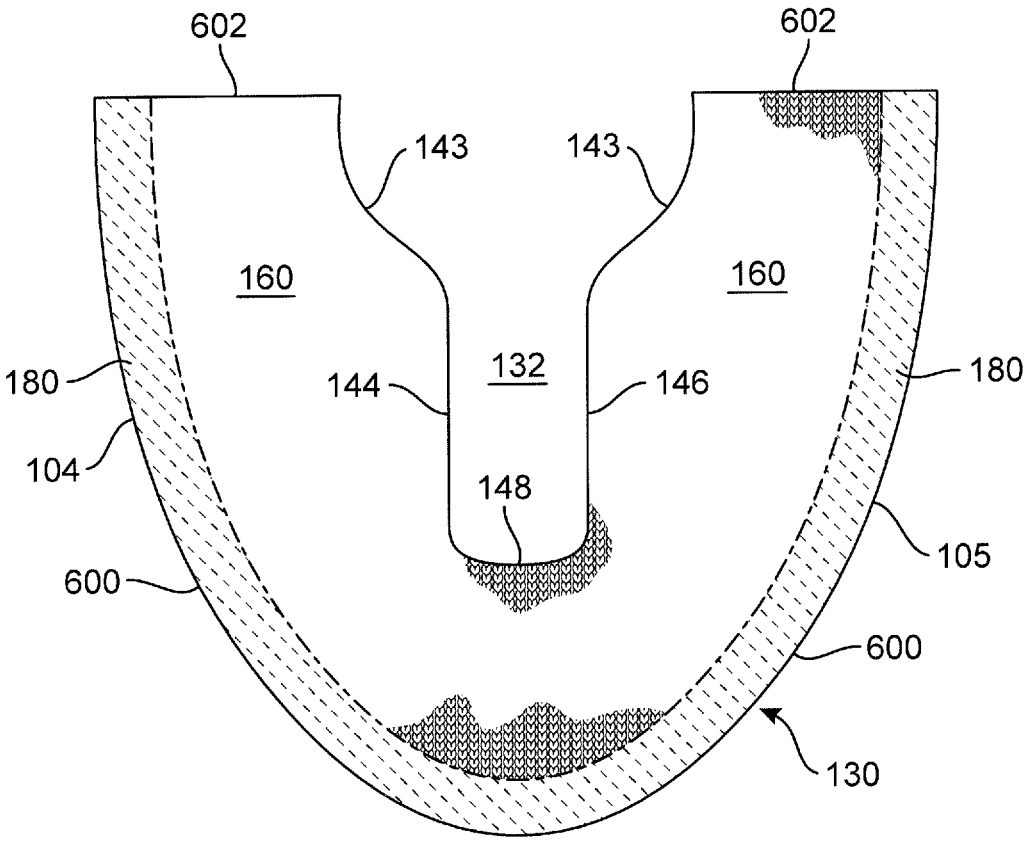
FIG. 4 is a top plan view of an exemplary embodiment of a knitted component with an area of first yarn and an area of second yarn.

FIG. 4, FIG. 5, FIG. 6, FIG. 7, and FIG. 8 illustrate an exemplary embodiment wherein knitted component 130 is adapted to be attached to a strobel sock. In FIG. 4, knitted component 130 is shown in a planar or flat configuration. In this embodiment, knitted component 130 has a generally U-shaped configuration that is outlined by an outer perimeter edge 600. In this embodiment, outer perimeter edge 600 extends around knitted component 130 from lateral side 104 to medial side 105. The outer perimeter of knitted component 130 also includes a pair of heel edges 602 disposed on each of lateral side 104 and medial side 105. In an exemplary embodiment, knitted component 130 may further include an inner perimeter that will be associated with and define instep area 132. In this embodiment, the inner perimeter of knitted component 130 includes lateral inner perimeter edge 144 and medial inner perimeter edge 146. Lateral inner perimeter edge 144 and medial inner perimeter edge 146 are disposed on opposite sides of knitted component 130. Lateral inner perimeter edge 144 and medial inner perimeter edge 146 are spaced apart and define instep area 132 of upper 120. Additionally, the inner perimeter further includes forward edge 148. In embodiments where article 100 includes tongue 124 that extends through instep area 132, tongue 124 maybe joined or attached to upper 120 at forward edge 148 of knitted component 130.

In various embodiments, knitted component 130 may incorporate various types of yarn that impart different properties to separate areas of upper 120. For example, one area or portion of knitted component 130 may be formed from a first type of yarn that imparts a first set of properties, and another area or portion of first knitted component 130 may be formed from a second type of yarn that imparts a second set of properties. In this configuration, properties may vary throughout upper 120 by selecting specific yarns for different areas of knitted component 130. In an exemplary embodiment, knitted component 130 includes a first portion 160 comprising a first yarn and a second portion 180 comprising a second yarn different from the first yarn. As described below, knitted component 130 may be formed of unitary knit construction such that each of the areas of knitted component 130, including first portion 160 and second portion 180, are knitted as a one-piece element.

Knitted component 130 can be formed of unitary knit construction. As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided. Examples of various configurations of knitted components and methods for forming knitted component 130 with unitary knit construction are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 2012/0233882 to Huffa, et al.; each of which is incorporated herein by reference in its entirety. Knitted component 130 remains formed of unitary knit construction when other elements, such as a lace, lace apertures, logos, trademarks, placards with care instructions or other information, such as material information and size, tensile or structural elements, are added following the knitting procedure.

Figure 5:
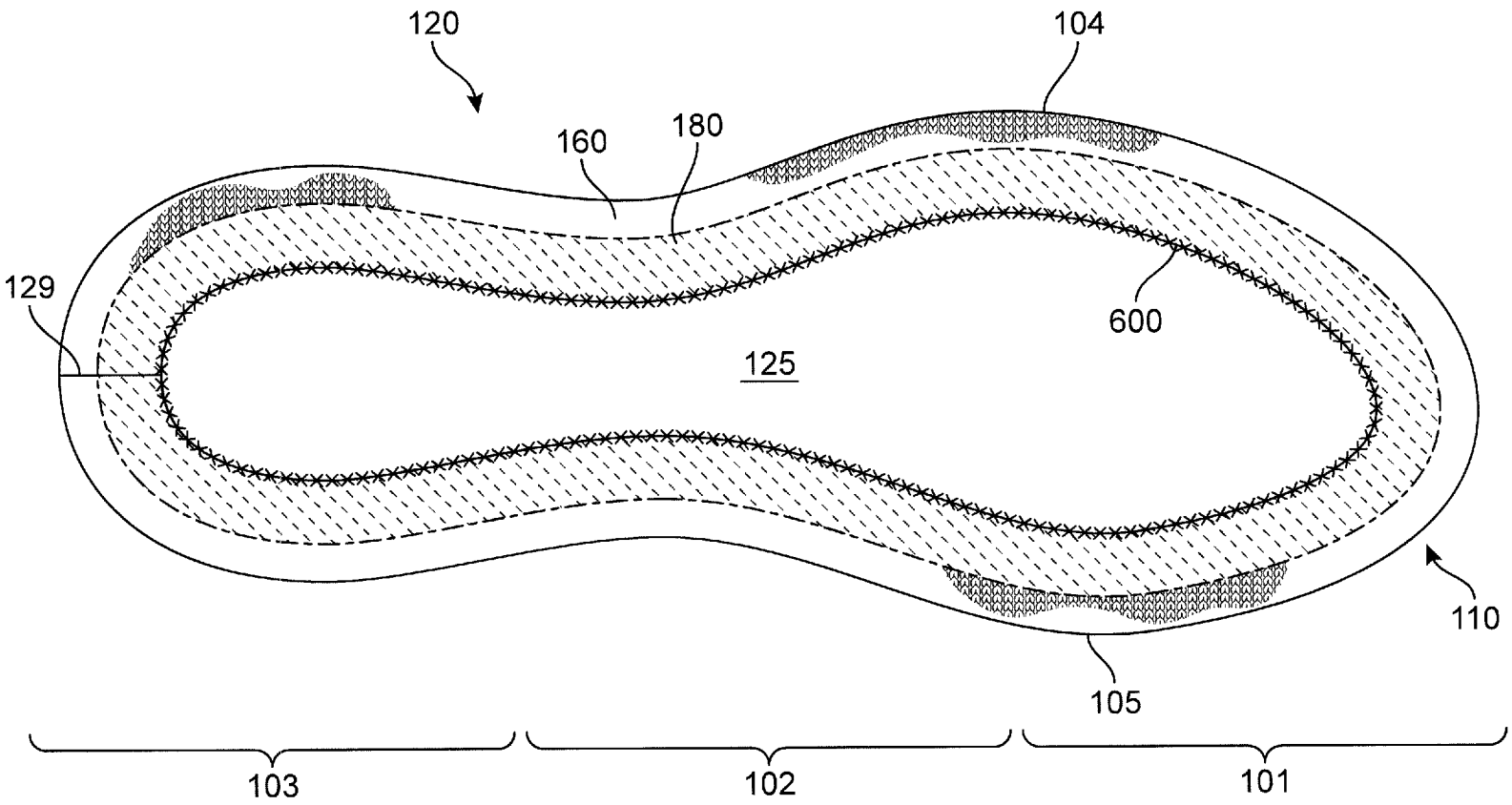
FIG. 5 is a bottom view of an exemplary embodiment of an upper of the article of footwear attached to a strobel.

In some embodiments, knitted component 130 may be joined to strobe sock 125 for attachment to sole structure 110, as illustrated in FIG. 5. Strobel sock 125 may be stitched to outer perimeter edge 600 of second portion 180 of knitted component 130. In addition, heel edges 602 are joined to each other and extend vertically in heel region 103 of article 100 to form seam 129. In some embodiments of an article of footwear, a material element may cover seam 129 between heel edges 602 to reinforce seam 129 and enhance the aesthetic appeal of the article.

Figure 6:
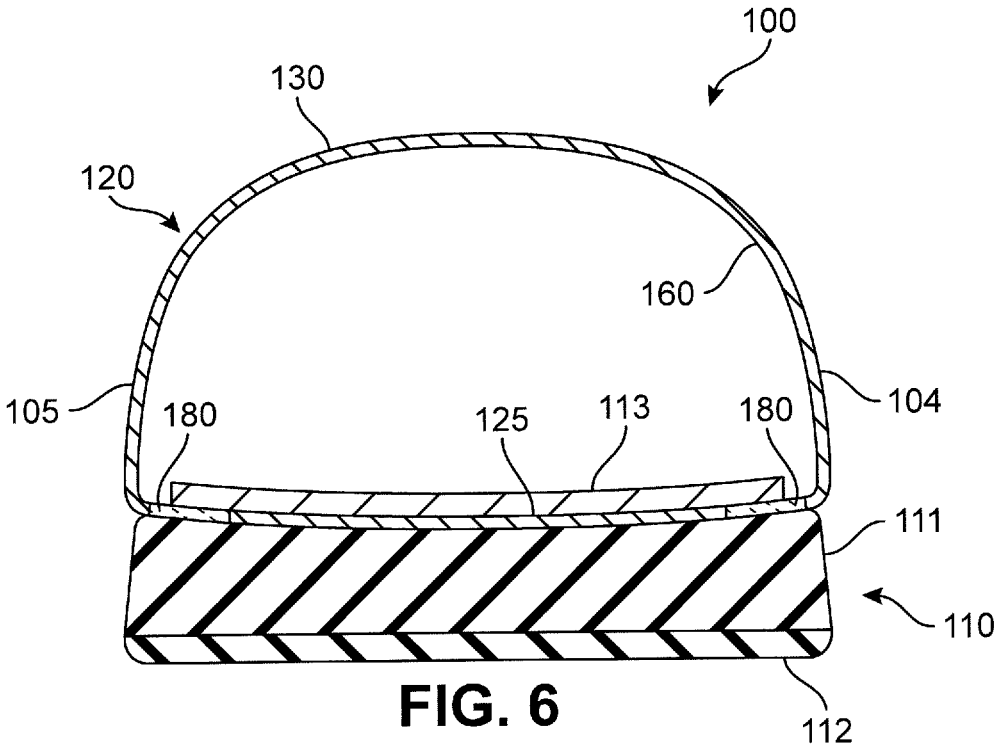
FIG. 6 is a cross-sectional view of an exemplary embodiment of the article of footwear defined by section lines 6 in FIG. 2 and FIG. 3.
Figure 7:
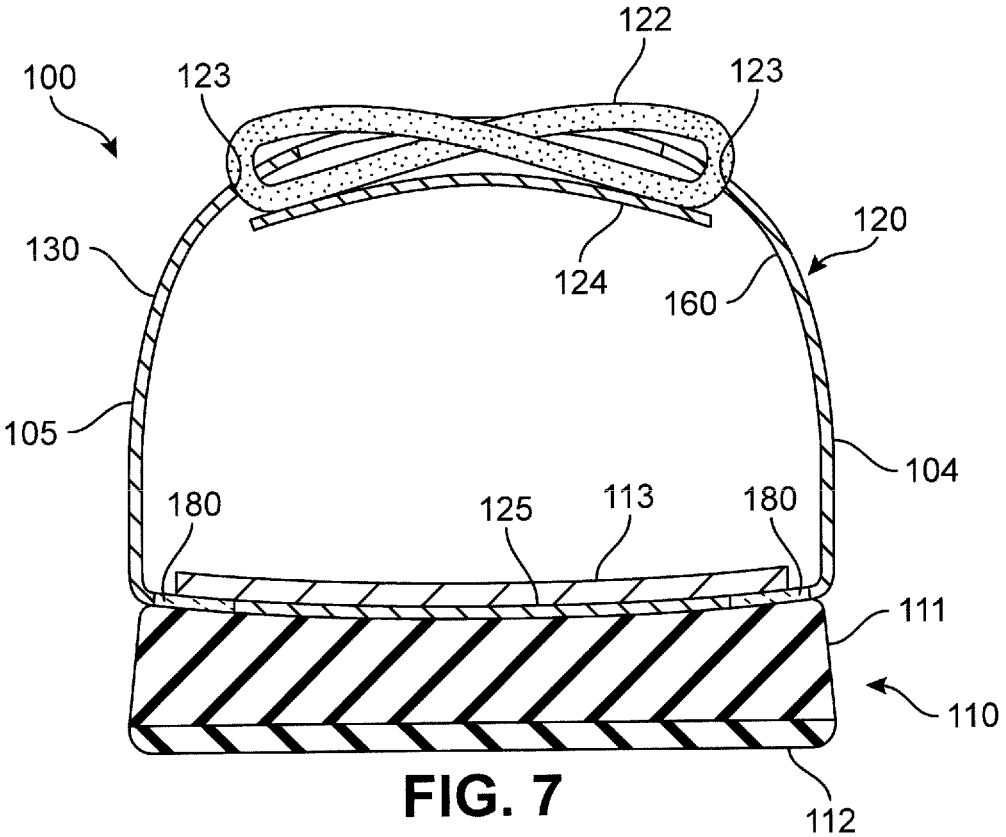
FIG. 7 is a cross-sectional view of an exemplary embodiment of the article of footwear defined by section lines 7 in FIG. 2 and FIG. 3.
Figure 8:
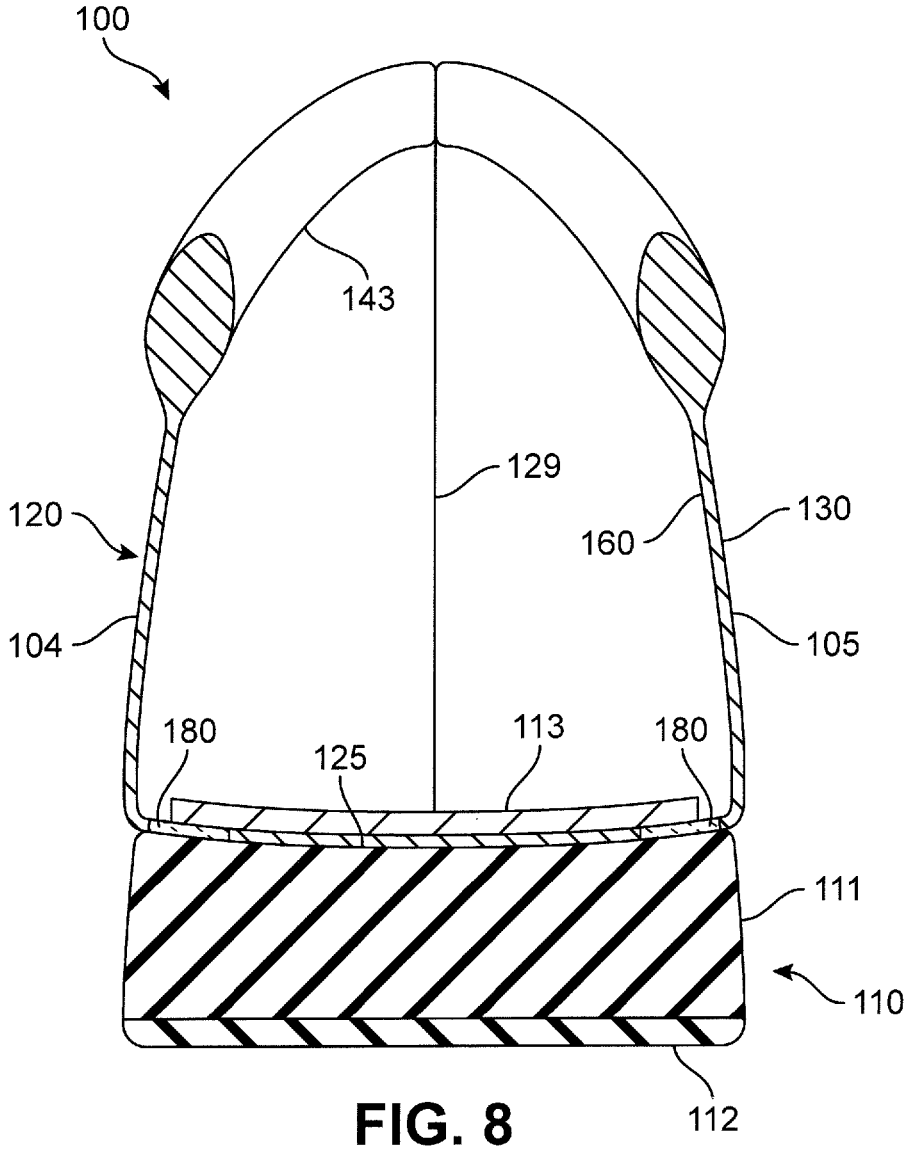
FIG. 8 is a cross-sectional view of an exemplary embodiment of an article of footwear defined by section lines 8 in FIG. 2 and FIG. 3.

Referring now to FIG. 6, FIG. 7, and FIG. 8, knitted component 130 is incorporated into upper 120 of article of footwear 100. As illustrated, first portion 160 of knitted component 130 extends from lateral side 104 to medial side 105 of upper 120. Second portion 180 of knitted component 130 is secured to strobel sock 125, forming a portion of upper 120 that extends under a portion of sockliner 113. FIG. 7 also illustrates lace 122 and tongue 124, which may be present on upper 120. Lace 122, if present, may pass through lace apertures 123.

Knitted component 130 may include instep area 132 of upper 120. In some embodiments, instep area 132 may include a plurality of lace apertures 123 disposed in knitted component 130. Lace apertures 123, if present, may extend through knitted component 130 and may be configured to receive a lace, including lace 122. In an exemplary embodiment, lace apertures 123 may be formed directly into knitted component 130 by knitting. In other embodiments, however, lace apertures 123 may include additional reinforcing elements added to knitted component 130. In other embodiments, knitted component 130 may not include lace 122 or lace apertures 123.

In some embodiments, a strobel sock is not used. Rather, second portion 180 is formed so that outer perimeter edge 600 may be joined under sockliner 113. In such embodiments, second portion 180 of knitted component 130 is wider than the corresponding portion for use with a strobel because the stitched-together second portion 180 essentially spans the width of the article of footwear.

Figure 9:
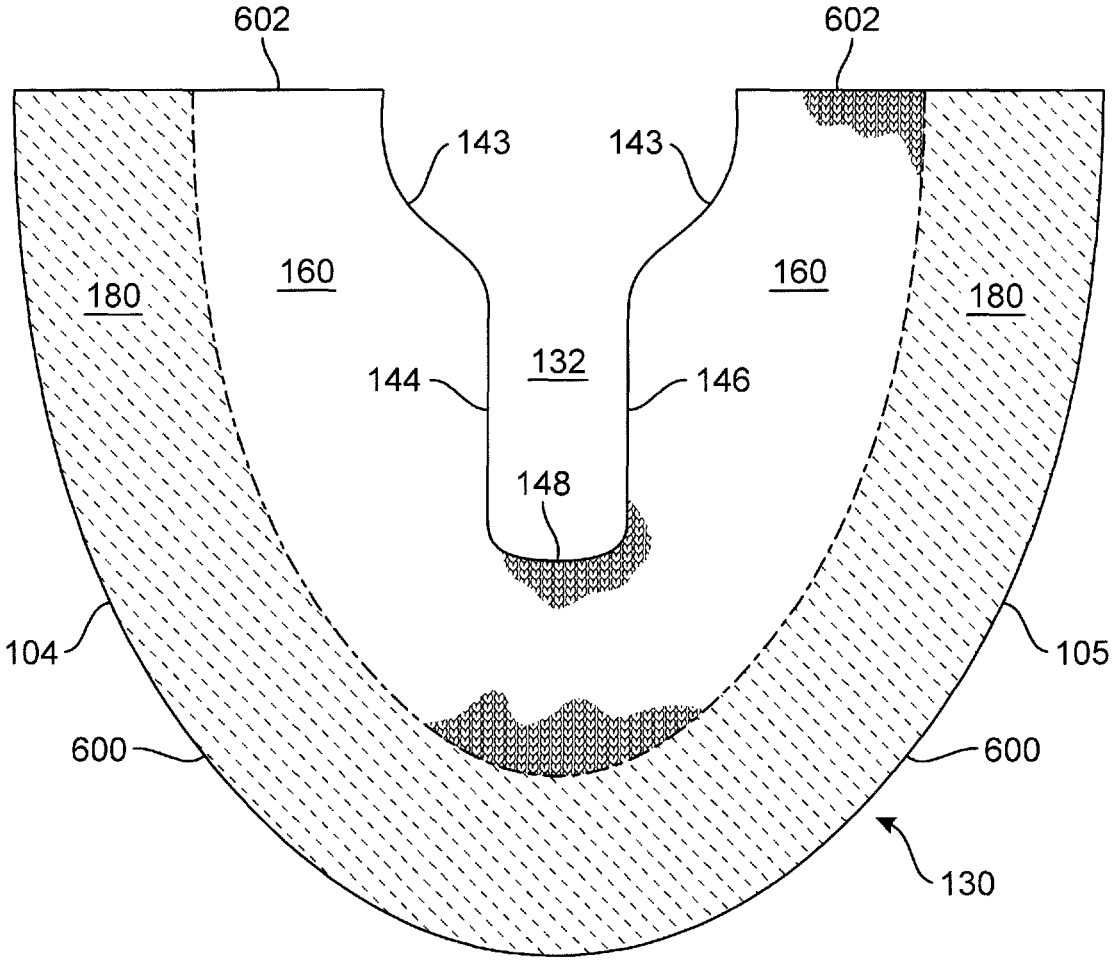
FIG. 9 is a top plan view of another exemplary embodiment of a knitted component with an area of first yarn and an area of second yarn.

FIG. 9 illustrates such an embodiment of the disclosure. Second portion 180 is wider than second portion 180 of FIG. 4, and is adjacent first portion 160. The dimensions of second portion 180 are established so that outer perimeter edge 600 on lateral side 104 can be stitched to or otherwise attached to outer perimeter edge 600 on medial side 105 to form a void for the wearer's foot when knitted component 130 is associated with sole structure 110 to form article of footwear 100.

Figure 10:
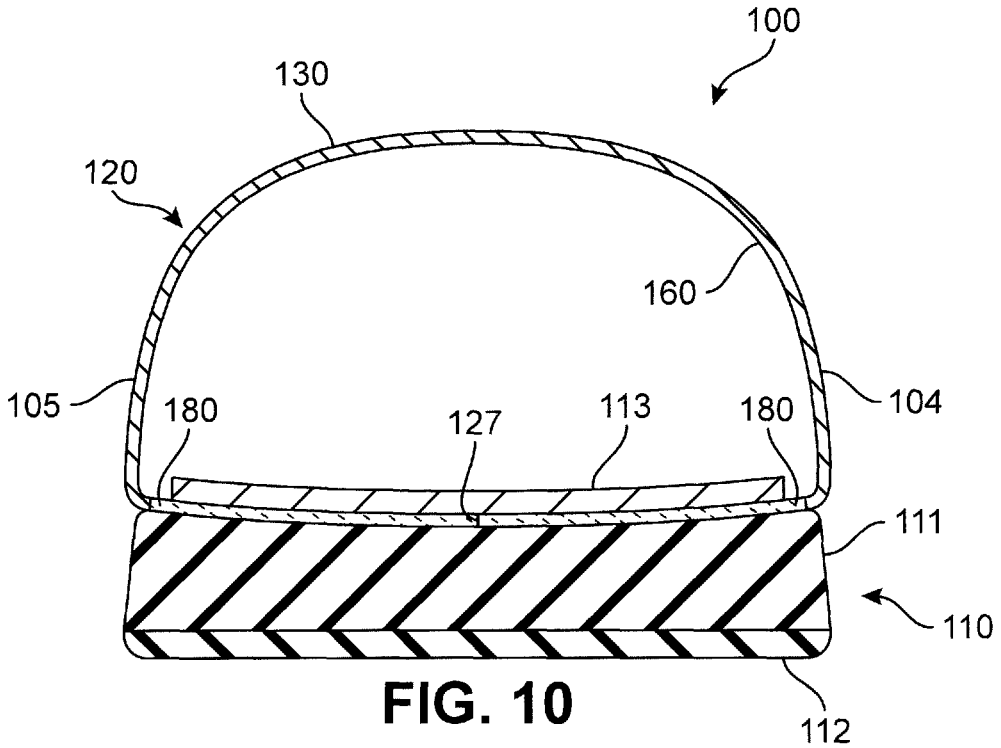
FIG. 10 is a cross-sectional view of another exemplary embodiment of the article of footwear defined by section lines 6 in FIG. 2 and FIG. 3.
Figure 11:
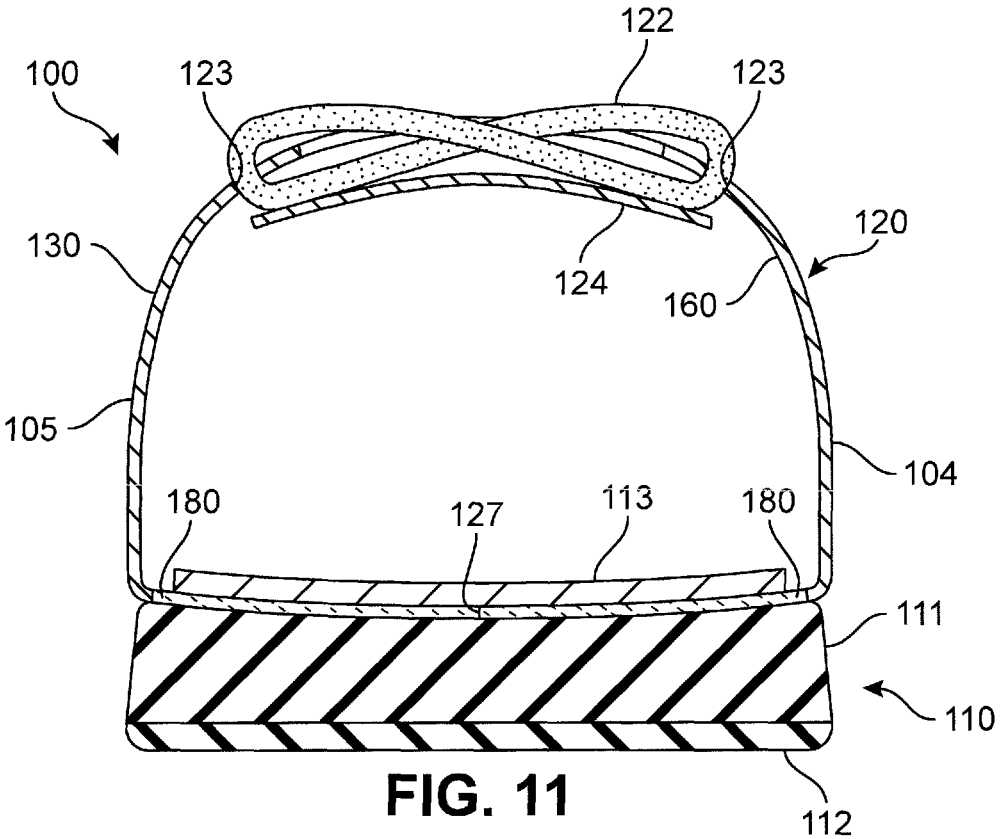
FIG. 11 is a cross-sectional view of another exemplary embodiment of the article of footwear defined by section lines 7 in FIG. 2 and FIG. 3.
Figure 12:
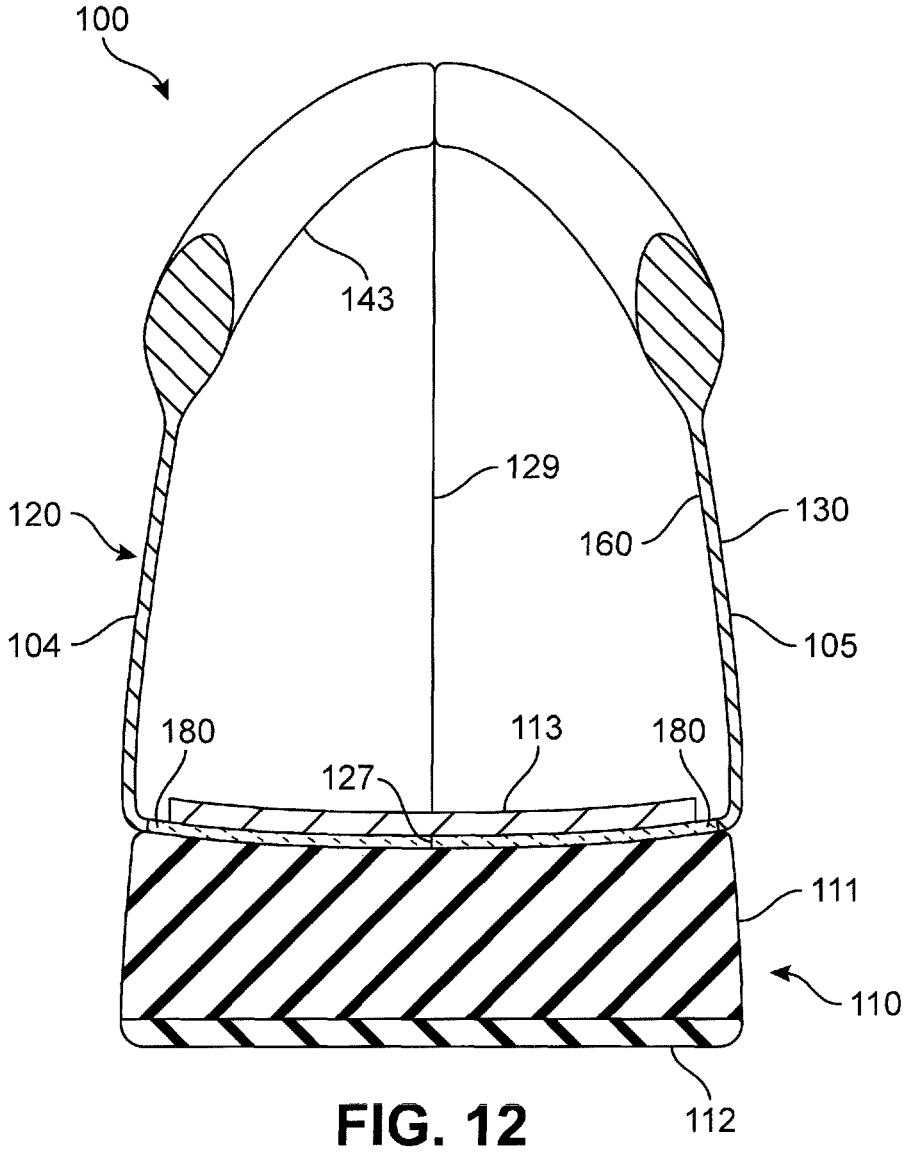
FIG. 12 is a cross-sectional view of another exemplary embodiment of an article of footwear defined by section lines 8 in FIG. 2 and FIG. 3.

Turning now to FIG. 10, FIG. 11, and FIG. 12, the lateral side of second portion 180 may be stitched to or otherwise attached to the medial side of second portion 180, essentially spanning the width of the article of footwear 100, to form a void for the wearer's foot, as illustrated in FIG. 10, FIG. 11, and FIG. 12. In some embodiments, the width of second portion 180 on lateral side 104 may be essentially equal to the width of second portion on medial side 105.

In some embodiments, seam 127 resulting from the stitching or joining together of the sides of second portion 180 may be located essentially on the longitudinal midline of article of footwear 100 if the size of second portion 180 is essentially the same on each side of article of footwear 100. In other embodiments of the disclosure, the seam may be located anywhere under sockliner 113. Such an adjustment can be made by making one side of second portion 180 wider than the other.

Figure 13:
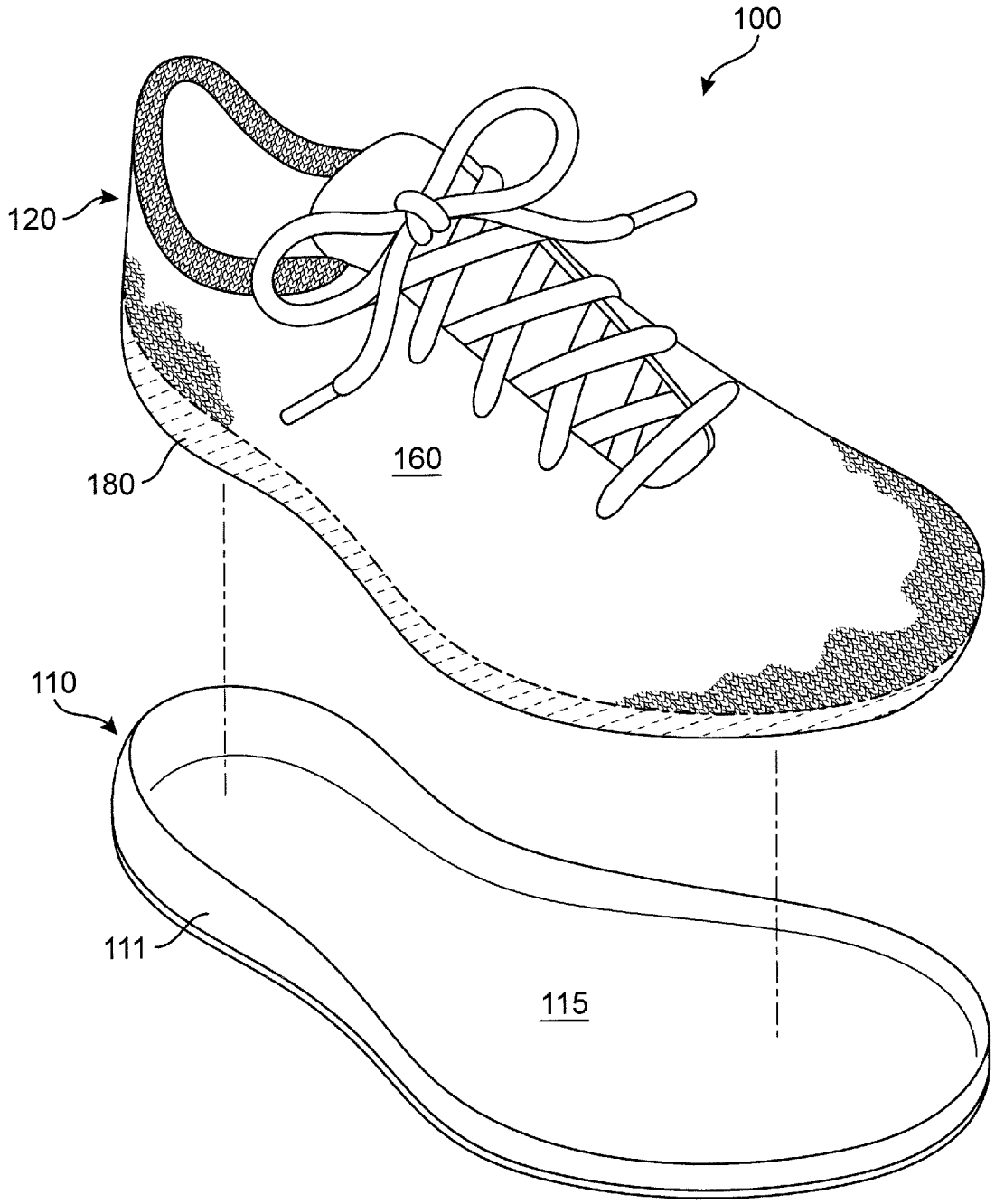
FIG. 13 is an exploded schematic view of an embodiment of an exemplary article of footwear.

The relationship between upper 120 and sole structure 110 is illustrated in FIG. 13. In some embodiments, upper 120 of article of footwear 100 may be sewn along outer perimeter edges 600 on the lateral side and medial side of second portion 180. In other embodiments, strobel sock 125 may be sewn to outer perimeter edge 600 of second portion 180. Upper 120 and upper surface 115 of midsole 111 are attached to each other, typically by adhesive bonding.

Figure 14:
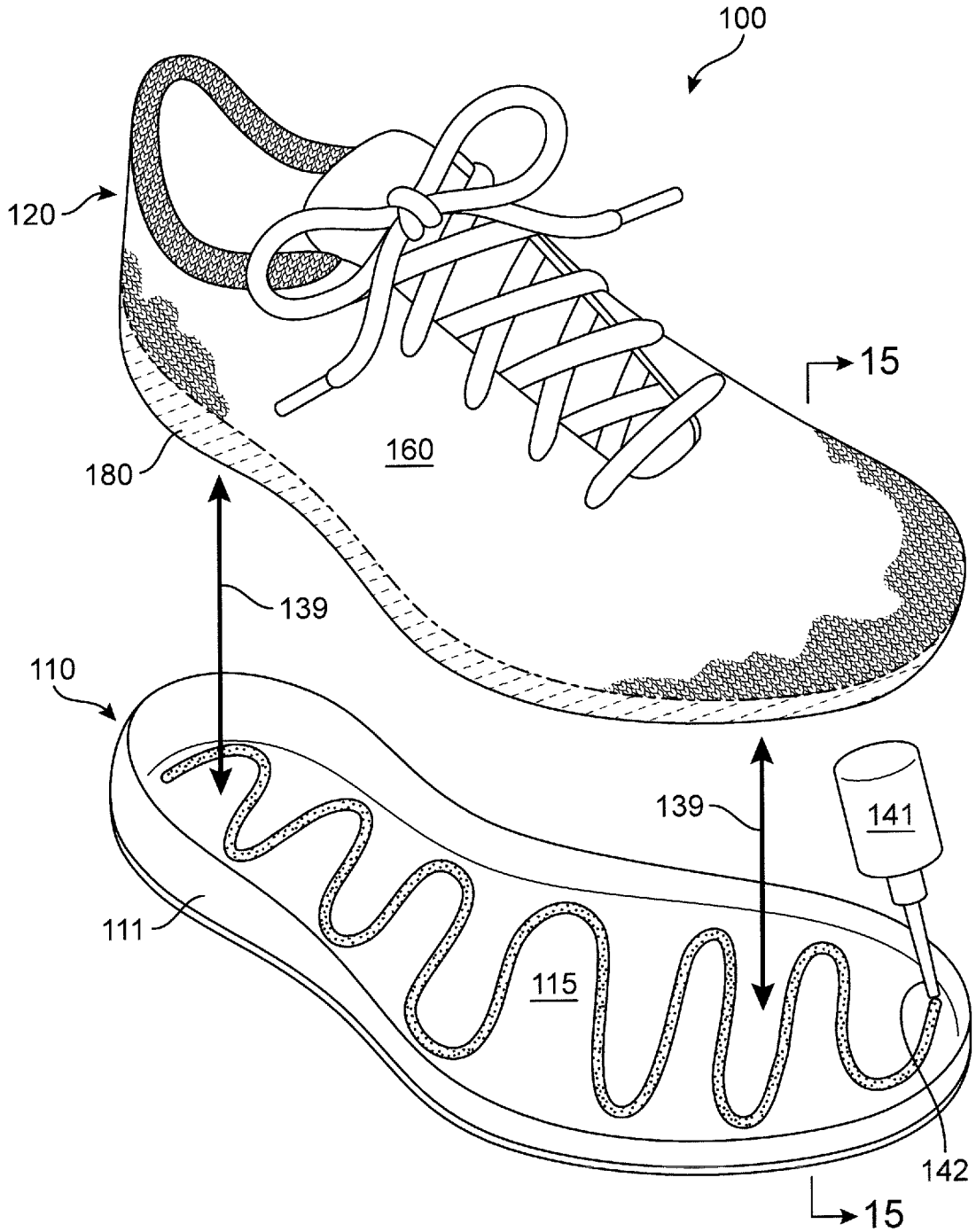
FIG. 14 is a schematic view of an exemplary method of manufacturing an article of footwear.

An exemplary embodiment of a method disclosed herein is illustrated in FIG. 14. In some embodiments, upper 120 is prepared for attachment to surface 115 of midsole 111 in sole structure 110 by putting a strobel sock in place between outer perimeter edges 600 of second portion 180. In other embodiments, upper 120 is prepared by mating one side of outer perimeter edge 600 of upper 120 to the opposite side outer perimeter edge 600 to form a surface for attachment to surface 115 of midsole 111.

In some embodiments, the location of the portion of knitted component 130 that is associated with sole structure 110 when upper 120 is attached to the sole structure 110 to form article of footwear 100 may be referred to as the "bite line". In an exemplary embodiment, the bite line may extend a small distance in the vertical direction upwards along upper 120 around the perimeter of article of footwear 100. In some cases, the bite line may include a visual indication on knitted component 130 to facilitate alignment and joining of upper 120 with sole structure 110. In other cases, however, the bite line may not be visually indicated on knitted component 130. In one embodiment, the bite line of knitted component 130 may correspond with the location and arrangement of second portion 180 on knitted component 130. With this configuration, the properties of second portion 180 may facilitate the attachment of sole structure 110 to upper 120.

Referring again to the exemplary method of FIG. 14, in a next step, adhesive then may be applied to one or both of the surfaces to be adhered. Adhesive may be applied in any manner, such as by brushing, wiping, direct application from a nozzle or spray head. In one embodiment, adhesive 140 may be applied to surface 115, for example from container 141 through nozzle 142. In some cases, adhesive 140 may additionally be applied or extend to the sides or lip of sole structure 110 that are raised above surface 115. Then, upper 120 and sole structure 110 are moved together, as illustrated by movement arrows 139, and are pressed together for a time sufficient to bond upper 120 to sole structure 110. Adhesive 140 may cure after an initial bond is formed.

Figure 15:
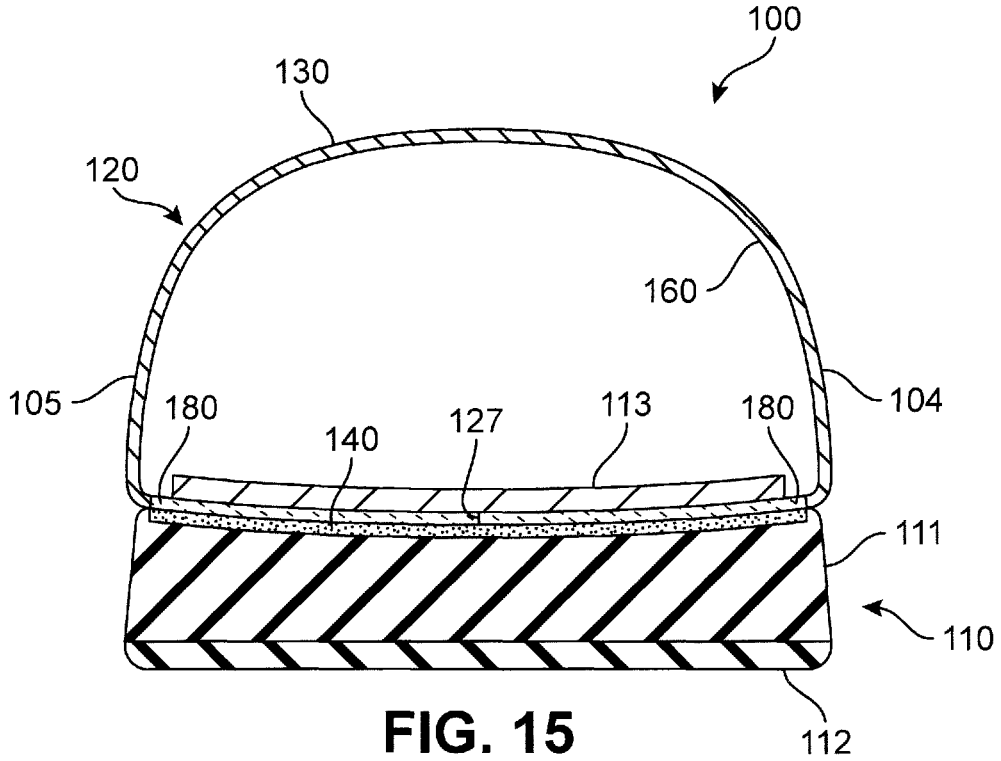
FIG. 15 is a magnified cross-sectional view along section line 15 on FIG. 14.

As can be seen in FIG. 15, which is a magnified cross-sectional view taken at section line 15 at FIG. 14, adhesive 140 covers the entirety or a substantial majority of the bottom of second portion 180 and surface 115 of midsole 111. Adhesive 140 thus forms a layer between the bottom of second portion 180 and midsole surface 115, as can be seen in the magnified cross-sectional view.

Figure 16:
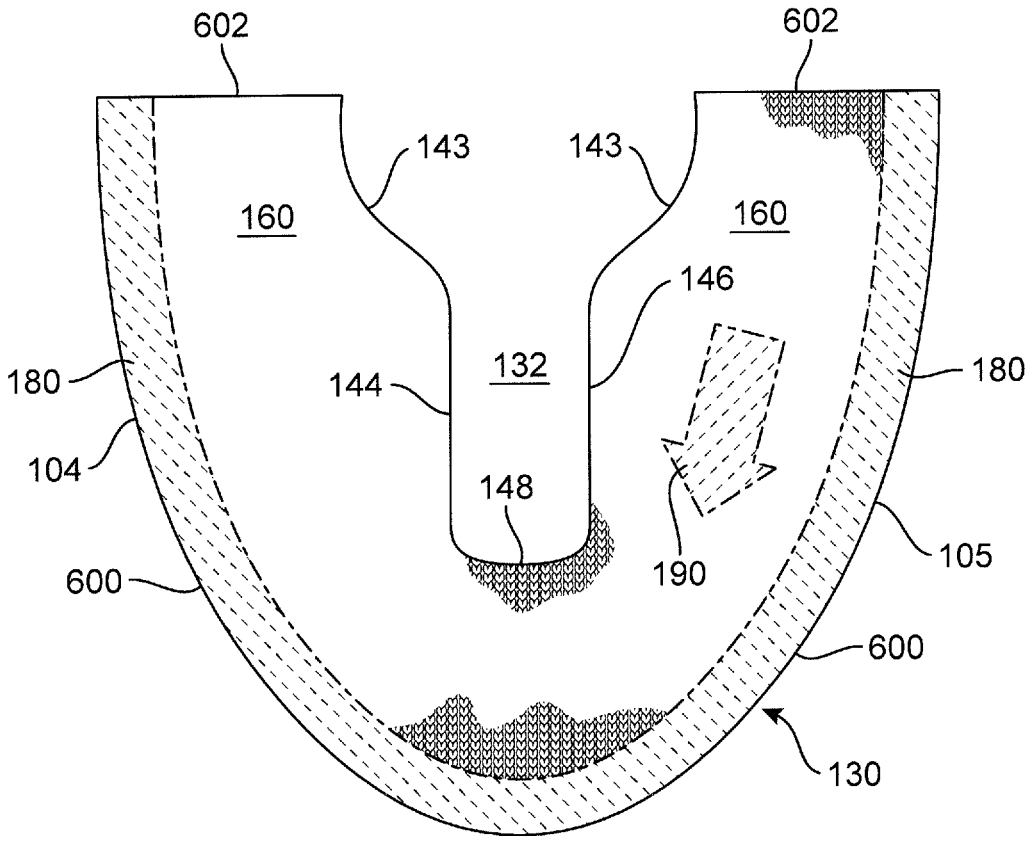
FIG. 16 is a top plan view of an exemplary embodiment of a knitted component with an area of first yarn and areas of second yarn.

In some embodiments, a third portion having yarn that does not have durable water repellence may be included within the first portion. Such a third portion may, for example be useful as an area to which a water-based materials may be applied to form an indicium such as a word, a symbol, as shape, or a design. In FIG. 16, third portion 190 is illustrated as an arrow on medial side 105. However, third portion 190 may take any shape or shapes, and may be formed anywhere on upper 120. For example, third portion 190 may be located in an area where a structural or other feature, such as a toe cap or a heel counter, may be adhered to upper 120 with a water-based adhesive. Third portion 190 may be formed by any yarn that will form an appropriate substrate for the water-based material forming the indicium. For example, in some embodiments, the yarn used to form second portion 180 may be suitable. In other embodiments, the yarn used to form third portion 190 may be the same type as the yarn used to form second portion 180, but may have a different color.

In some embodiments, a fourth portion having yarn that has durable water repellant properties may be included in a rand, an area vertically above the biteline on the outside of the upper of an article of footwear. In some embodiments, both a third portion and a fourth portion may be present.

In some embodiments, upper 120 may include any number of tensile strands or tensile elements inlaid or placed along any suitable area of upper 120 without departing from the scope of the present disclosure. Moreover, tensile strands suitable for use with upper 120 may include the tensile strands and/or tensile elements and the method of manufacturing a knitted component incorporating tensile strands or tensile elements disclosed in one or more of commonly-owned U.S. application Ser. No. 13/048,540 to Huffa et al., entitled "Method Of Manufacturing A Knitted Component", filed on Mar. 15, 2011 and published as United States Patent Application Publication No 2012/0234052 on Sep. 20, 2012; U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, all of which applications are hereby incorporated by reference in their entireties.

Various methods, machines, and tools can be used for forming, treating, and otherwise adjusting knitted component 130 and for forming article of footwear 100 from upper 120 incorporating knitted component 130. It will be appreciated that the order of steps within the method may vary from the order described herein. Certain steps or aspects of some steps may be skipped or eliminated as well. Moreover, two or more steps within the method may be carried out sequentially or simultaneously. Furthermore, the steps within the method may be carried out manually or automatically, using any suitable tool, machine, or implement.

Generally, in exemplary embodiments of the method, a knitting process is used to form a knitted component 130, such as knitted component 130 shown in FIG. 4, FIG. 9, and FIG. 16. Then, knitted component 130 can be further processed and adjusted, for example, by securing knitted component 130 to a workpiece, adjusting tensile strands, if appropriate, and steaming. Additional steps of the method depend upon whether a strobel is to be used. If a strobel is present, the next method step may be to attach the strobel to the knitted component, as illustrated in FIG. 5. Then, strobel 125 and sole structure 110 may be attached, such as by adhesion, to finish construction of article of footwear 100. If no strobel is present, the outer perimeter edge and at least a portion of the heel edges may be arranged to form an upper having a bottom. Then, sole structure 110 is attached to upper 120.

In some embodiments, a knitted component for use with article of footwear 100 may be steamed during manufacture. Steaming of knitted component 130 may assist with setting and arranging the individual yarns of knitted component 130 into an orderly configuration. A durable water repellence-providing composition also may be provided before or during steaming. FIG. 17, FIG. 18, FIG. 19, and FIG. 20 illustrate embodiments by which durable water repellence-providing compositions can be applied.

Figure 17:
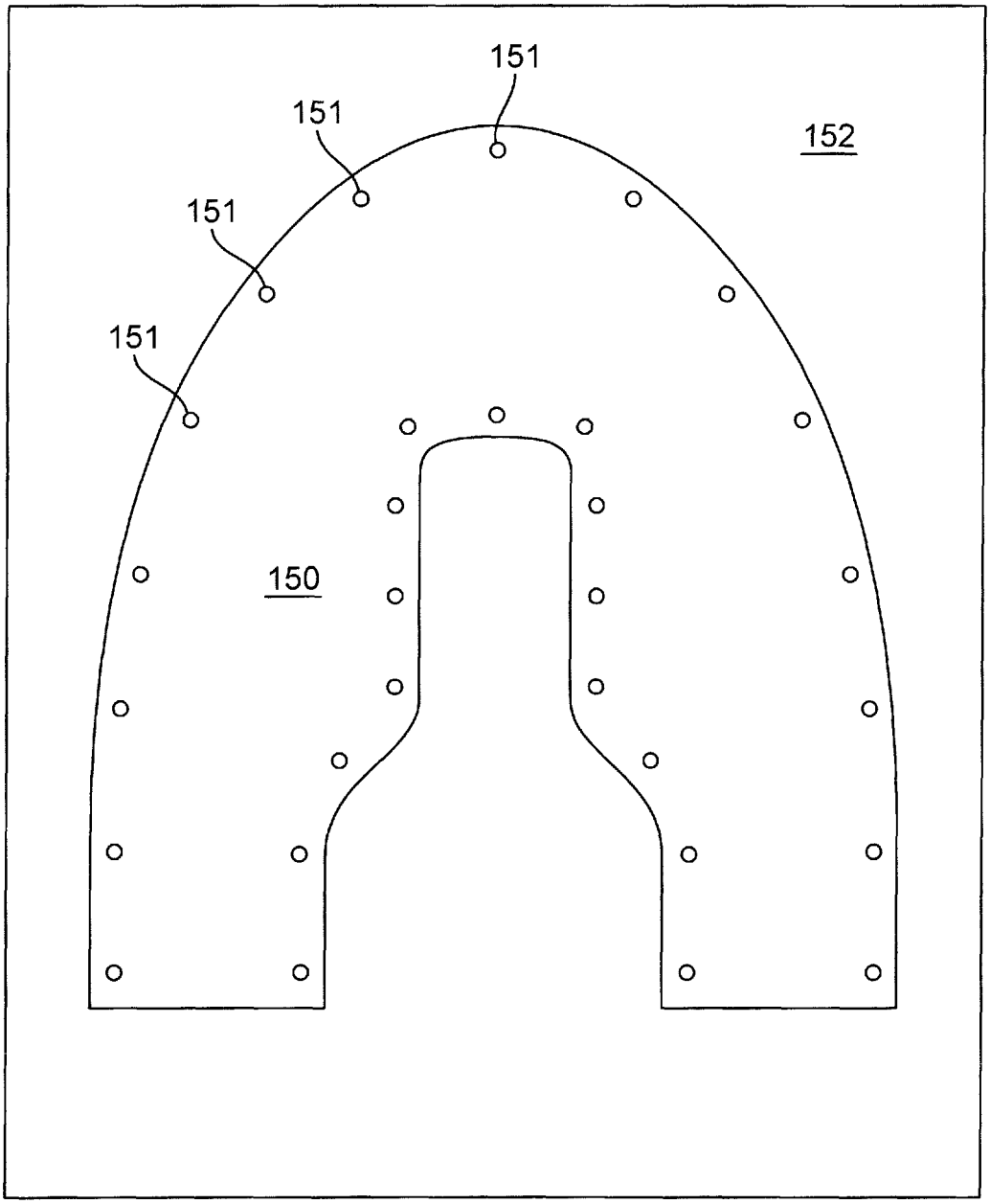
FIG. 17 is a top plan view of a knitted component on a holder.
Figure 18:
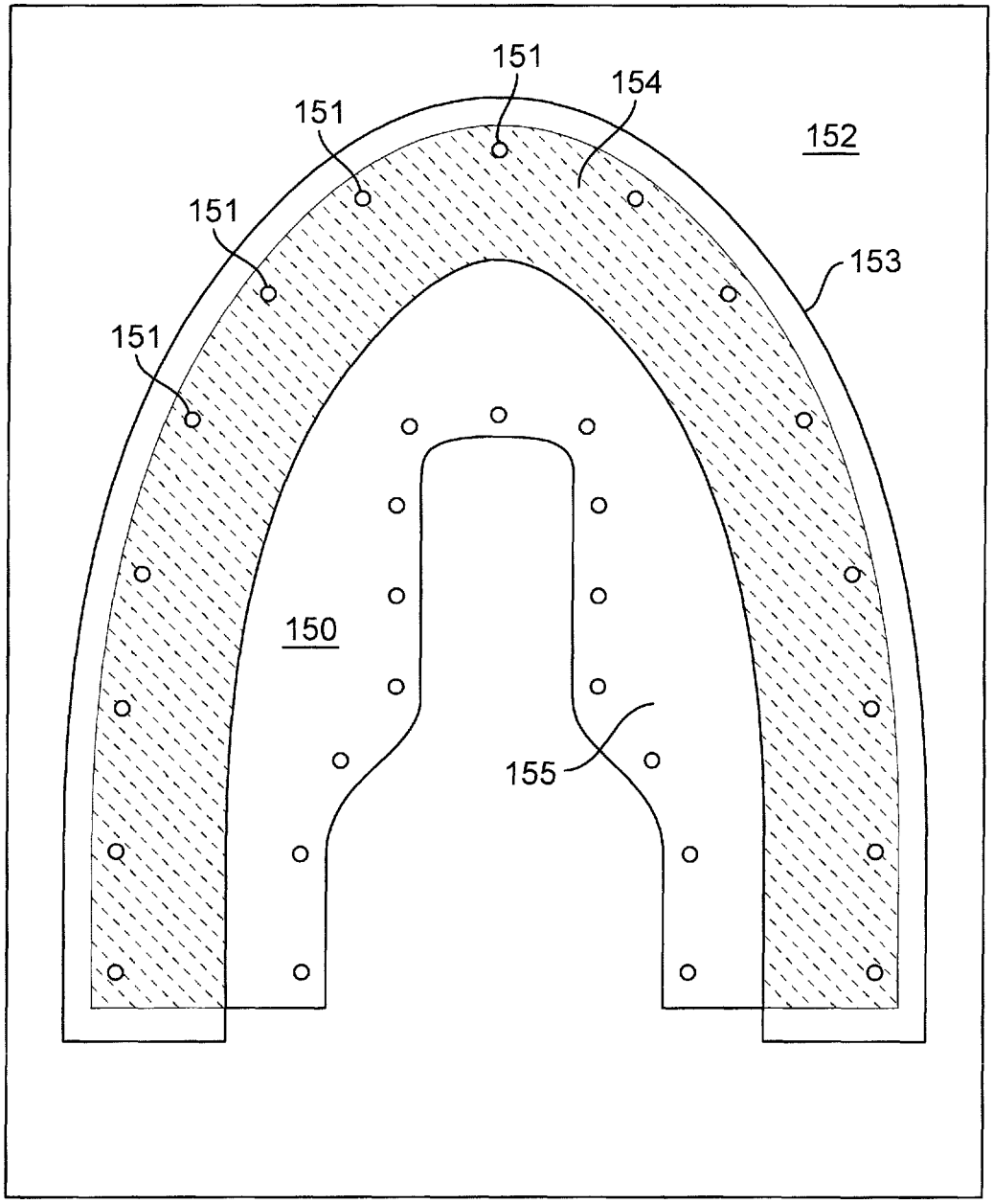
FIG. 18 is a top plan view of a knitted component on a holder under a removable mask.

FIG. 17 and FIG. 18 illustrate knitted component 150 held in place by retainers 151 on holder 152. In an exemplary embodiment, knitted component 150 may differ from knitted component 130, described above. In this embodiment, knitted component 150 is knitted of yarn that does not have significant durable water repellant properties. As shown in FIG. 18, a removable mask 153 may be placed over knitted component 150 to cover selected portions of knitted component 150 to preclude deposition of durable water repellence-providing composition. In an exemplary embodiment, removable mask 153 may be placed on knitted component 150 so as to cover second portion 154 of knitted component 150. Accordingly, as shown in FIG. 18, second portion 154 of knitted component 150 is disposed under removable mask 153. Thus, durable water repellence-providing composition supplied to knitted component 150 will be deposited only on first portion 155, leaving second portion 154 essentially untreated and, like second portion 180, suitable for use with water-based adhesive. In some embodiments, removable mask 153 also may be shaped to protect a third portion 190 within first portion 155 to form an area that can accept water-based indicia, as described above with regard to FIG. 16.

Figure 19:
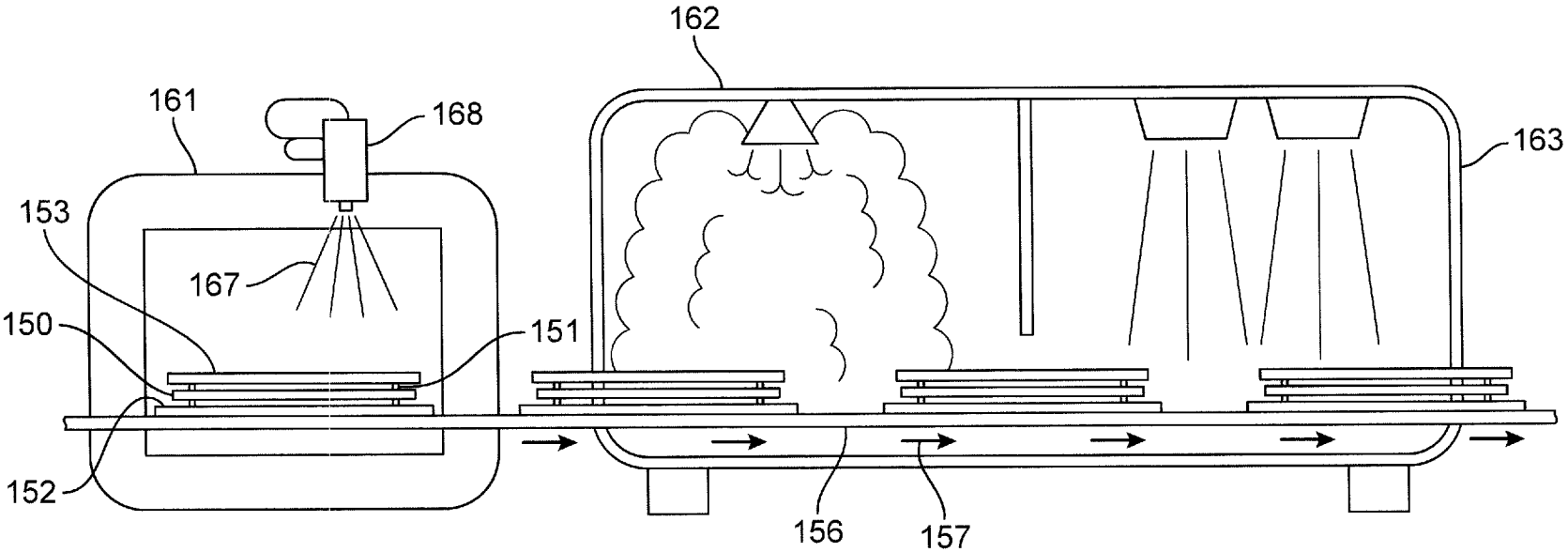
FIG. 19 is a schematic diagram of an embodiment of a process for applying durable water repellence-providing composition.
Figure 20:
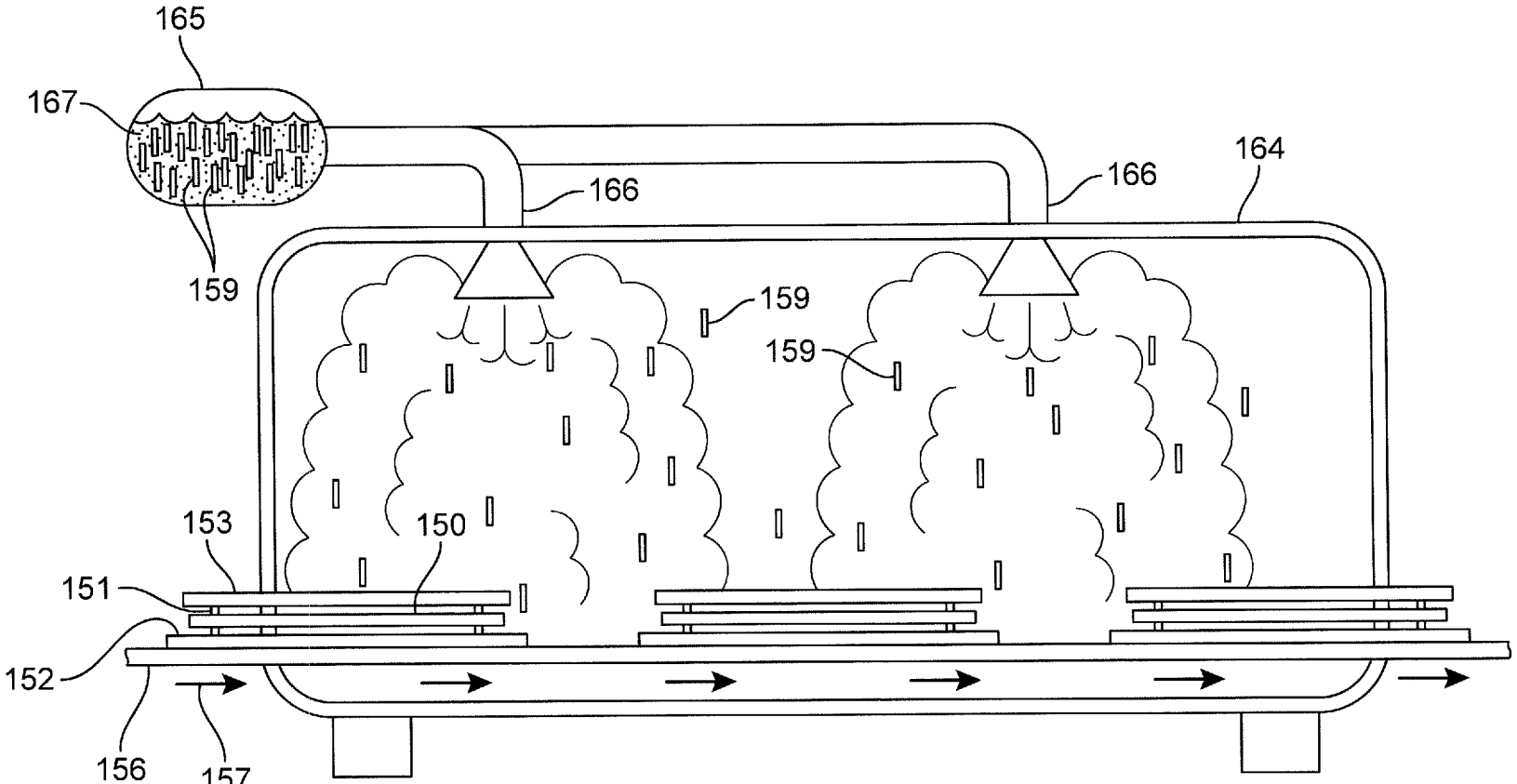
FIG. 20 is a schematic diagram of an embodiment of a process for applying durable water repellence-providing composition.

FIG. 19 and FIG. 20 illustrate schematically embodiments of methods of applying durable water repellant-providing composition after knitted component 150 has been knitted. FIG. 19 illustrates an embodiment including holders 152, including retainers 151, on which knitted component 150 and removable mask 153 may be retained. Holders 152 may be mounted on continuous belt 156 or other device for movement in the direction of arrows 157 sequentially through first chamber 161, second chamber 162, and third chamber 163. In first chamber 161, sprayer 168 may introduce durable water repellence-providing composition 167 on first portion 155 of knitted component 150, and removable mask 153 may preclude durable water repellence-providing composition 167 from depositing on second portion 154. Holder 152 and its contents then may be moved into second chamber 162, where knitted component 150 may be steamed, and then may be moved to third chamber 163, where knitted component 150 may be dried. Holder 152 and its contents then may be removed from third chamber 163 for further processing. In this method, illustrated in FIG. 19, the steam in second chamber 162 aids durable water repellence-providing composition 167 to penetrate the yarn in first portion 155 of knitted component 150.

Embodiments of the method illustrated in FIG. 20 involve application of durable water repellence-providing composition in steam chamber 164. FIG. 20 illustrates holders 152, including retainers 151, on which knitted component 150 and removable mask 153 may be retained. Holders 152 may be mounted on continuous belt 156 or other device for movement in the direction of arrows 157 to chamber 164. Tank 165 holds an aqueous mixture 167 containing durable water repellence-providing composition 159. The mixture may be transported through conduits 166 and the aqueous fraction may be vaporized in chamber 164. Durable water repellence-providing composition 159, shown as black rectangles for convenience, may be introduced with the steam caused by vaporization of the water in mixture 167 in chamber 164. The steam in chamber 164 aids penetration of durable water repellence-providing composition 167 into the yarn in first portion 155 of knitted component 150.

In some embodiments, these methods also may be used to mask an area to form a third portion within the first portion to form a third portion that is not treated with durable water repellence-providing composition. Water-based indicia may be applied to this third portion. Removable mask 153 may be used to cover the third portion.

Figure 21:
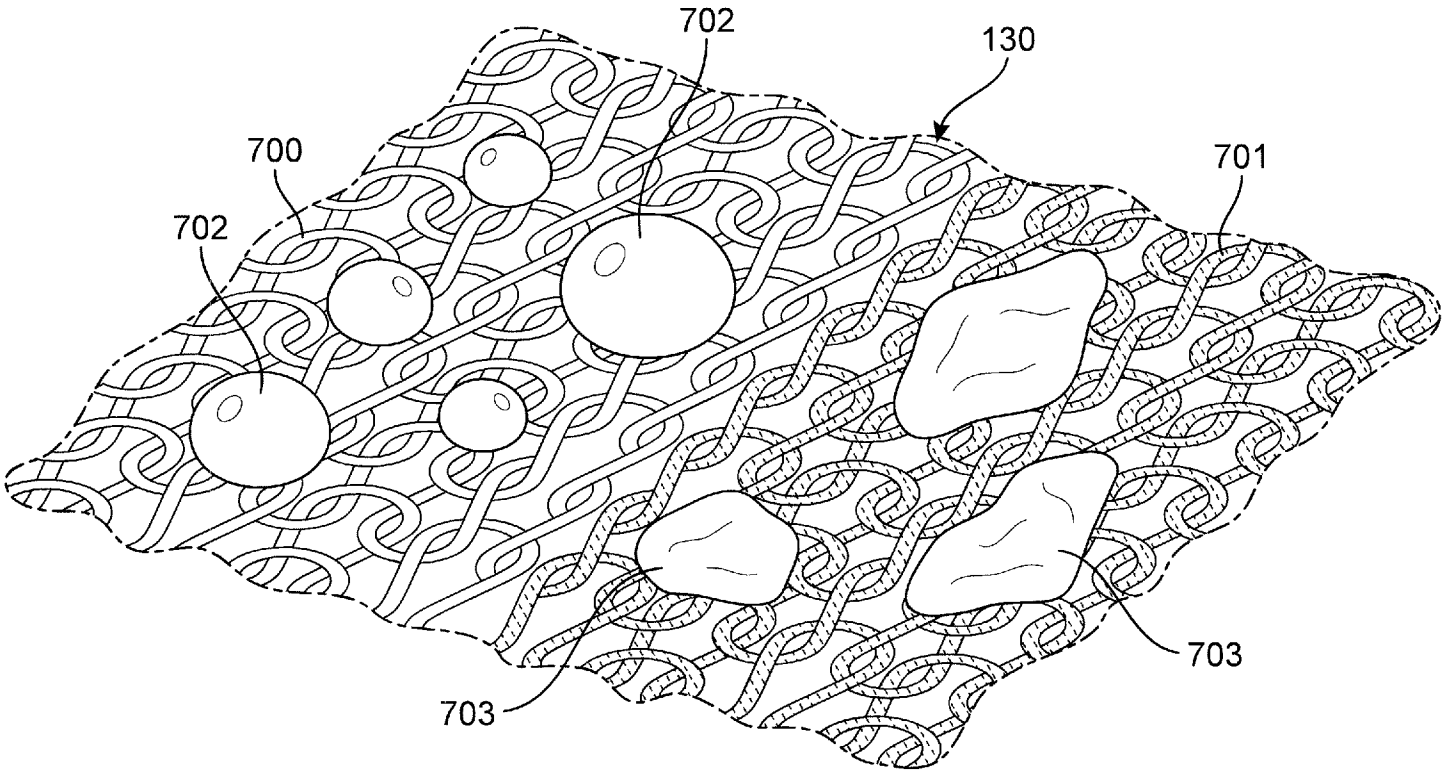
FIG. 21 is an orthographic view of the behavior of water on untreated yarn and on yarn treated with durable water repellant material.

Durable water repellence-providing compositions on yarn will cause water to be repelled, whereas water will not be repelled from the same yarn devoid of durable water repellence-providing material. Knitted component 130 is illustrated with two types of yarn in FIG. 21. Water forms beads 702 on yarn 700. As can be seen, the contact angle, i.e., the angle formed between the water drop and the surface of knitted component 130, is at least about 90°. In contrast, water spreads and forms puddles 703 rather than drops on untreated yarn 701. The contact angle of puddles 703 on untreated yarn 701 is less than about 90°, and typically may be less than or equal to about 45°. Low contact angles, i.e., angles less than about 90°, allow water-based adhesive to bind with untreated yarn 701 of knitted component 130 for attaching elements, such as sole structure 110 or other components, to knitted component 130.

Knitting Process

Figure 22:
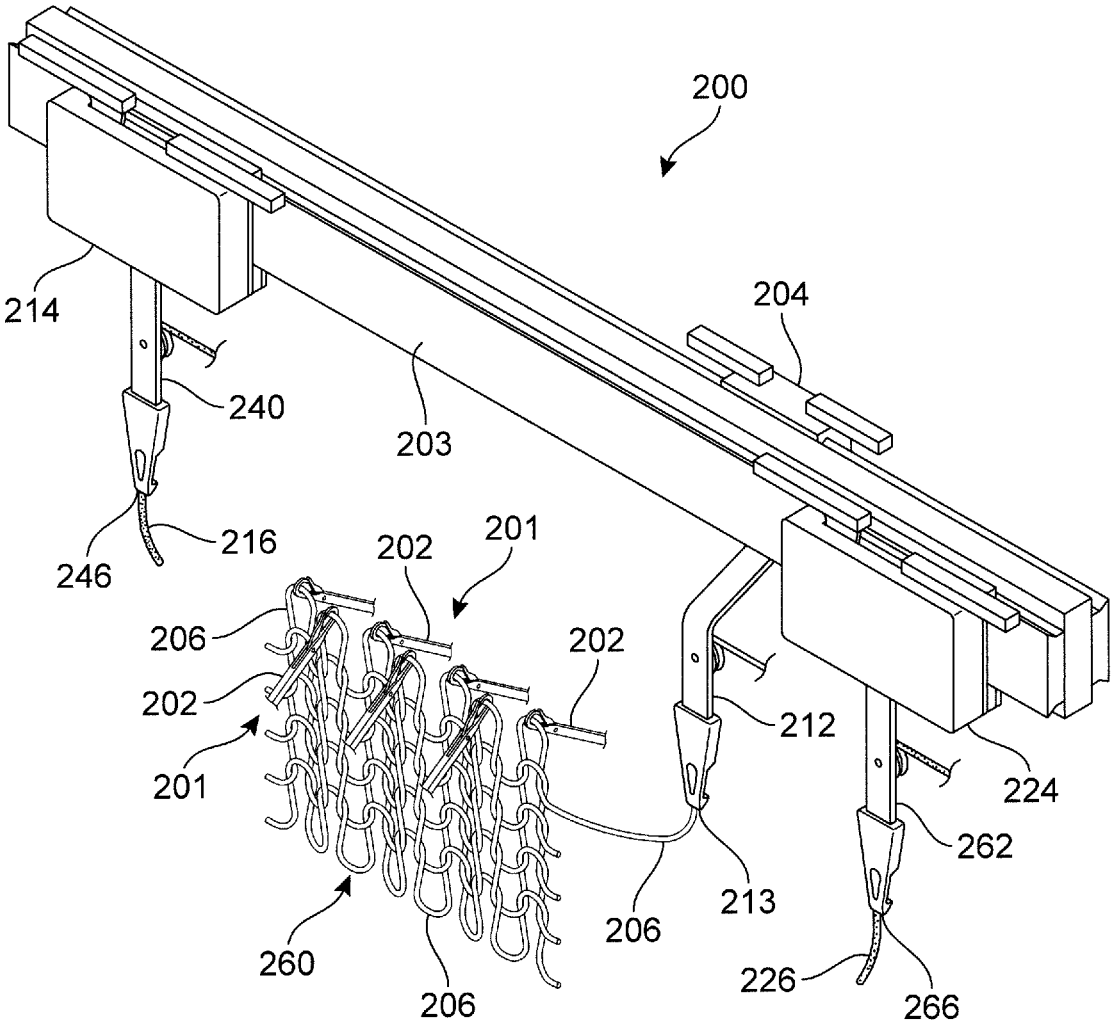
FIG. 22 is a schematic perspective view of a knitting process using conventional feeders.
Figure 23:
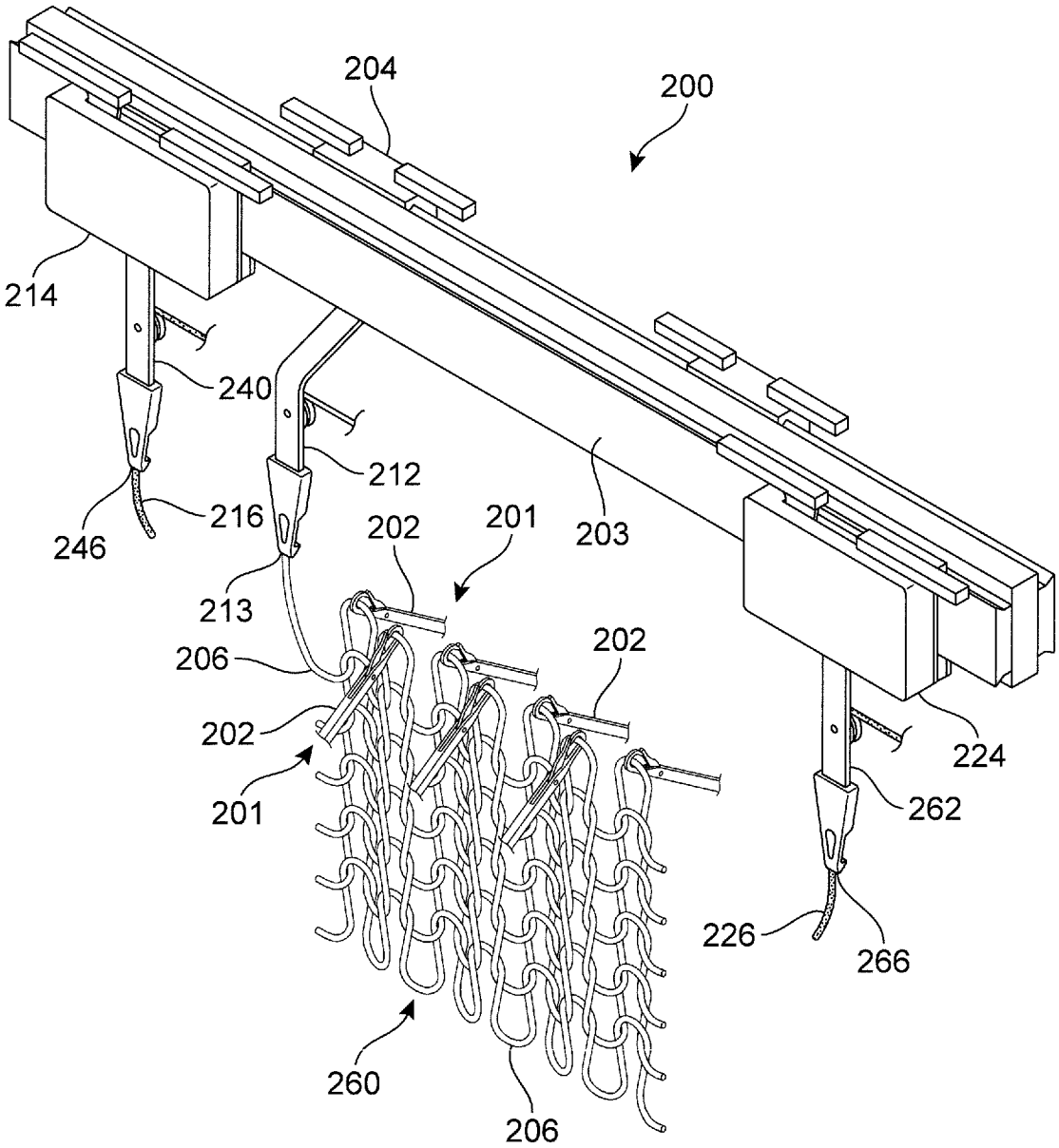
FIG. 23 is a schematic perspective view of a knitting process using conventional feeders.
Figure 24:
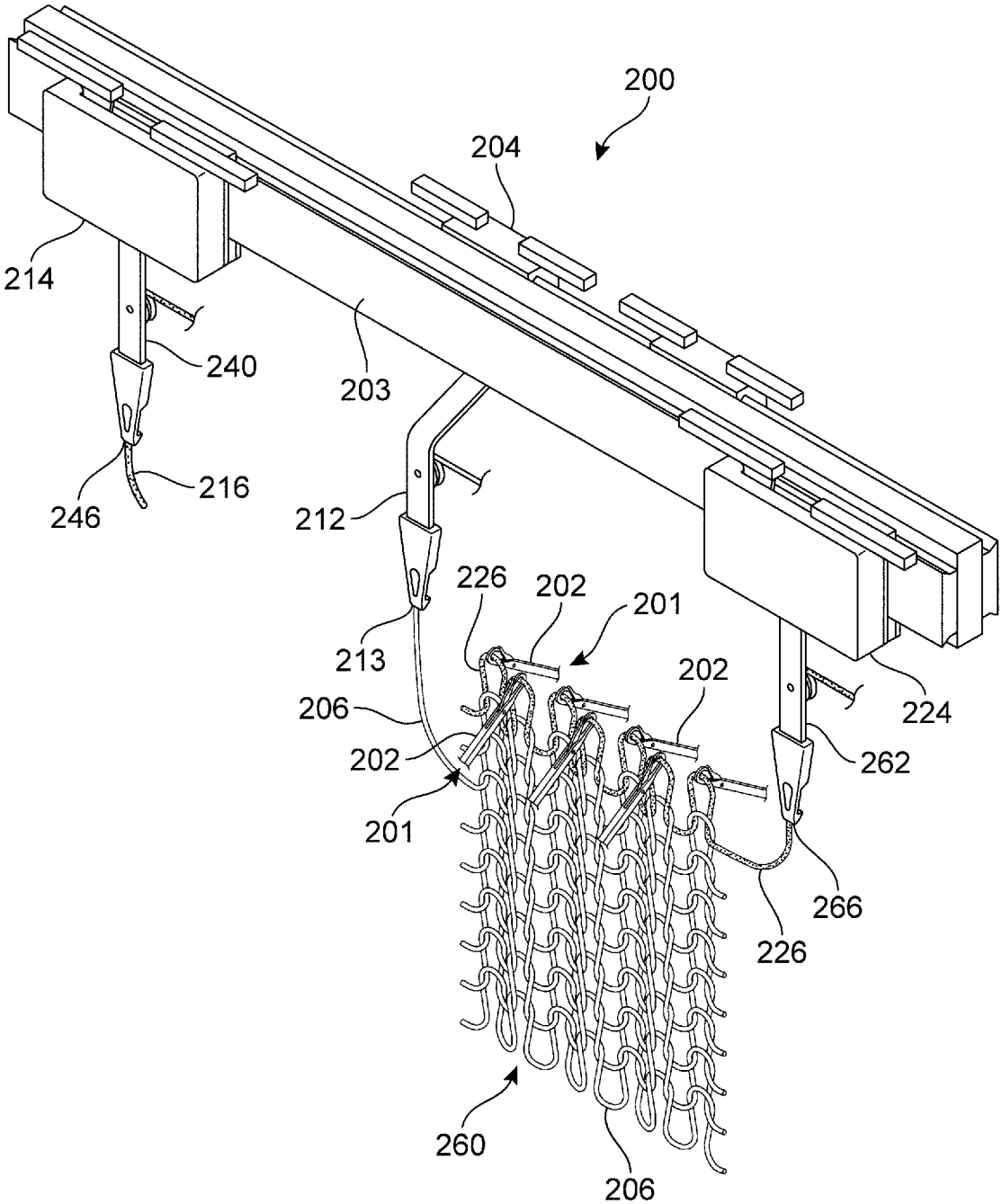
FIG. 24 is a schematic perspective view of a knitting process using conventional feeders showing introduction of the second yarn.

FIG. 22, FIG. 23, and FIG. 24 illustrate an exemplary process of knitting a knitted component, including a knitted component substantially similar to knitted component 130 described above. Referring to FIG. 22, a portion of knitting machine 200 that includes needles 202 and rail 203 is shown. Additionally, in this embodiment of the disclosure, knitting machine 200 may include first standard feeder 204, second standard feeder 214, and third standard feeder 224 that are substantially similar to each other. In addition, in embodiments of the disclosure wherein knitted component 130 includes tensile elements, a combination feeder (not shown) may be included to form a tensile element during the process of knitting knitted component 260. For the purposes of ease of illustration, therefore, knitted component 260 will be illustrated in FIG. 22 through FIG. 24 without a tensile element.

Referring again to FIG. 22, first standard feeder 204 may be secured to a rear side of rail 203, and second standard feeder 214 and third standard feeder 224 may be secured to a front side of rail 203. In other embodiments of the disclosure, additional feeders may be used and may be located on the front or rear side of rail 203.

In this embodiment, first yarn 206 from a spool (not shown) passes through first standard feeder 204 and an end of yarn 206 extends outwardly from first dispensing tip 213 at the end of first feeder arm 212. Although yarn 206 is depicted, any other strand (e.g., a filament, thread, rope, webbing, cable, chain, or yarn) may pass through first standard feeder 204. Second yarn 216 similarly passes through second standard feeder 214 and extends outwardly from second dispensing tip 246 on second feeder arm 240. Third yarn 226 may pass in a similar manner through third standard feeder 224 to third dispensing tip 266 on third feeder arm 262.

In an exemplary embodiment, second yarn 216 or third yarn 226 may be a different type of yarn than first yarn 206. In such an embodiment of the disclosure, first yarn 206 may be a yarn that has water-repellent properties, and second yarn 216 and third yarn 226 may not be water repellent. In an exemplary embodiment, second yarn 216 and third yarn 226 may be used to form lateral portions, medial portions, and other edge portions, generally described as second portion herein, and other portions, of a knit element forming knitted component 130, whereas first yarn 206 may be used to form the first portion of knitted component 130. In other embodiments of the disclosure, however, second yarn 216 and third yarn 226 may be different and may be used to form other portions of the knit element forming knitted component 130.

The knitting process discussed herein relates to the formation of a knitted component 260, which may be any knitted component, including knitted components that are similar to knitted component 130. For purposes of the discussion, only a relatively small section of knitted component 260 is shown in the Figures in order to permit the knit structure to be illustrated. Moreover, the scale or proportions of the various elements of knitting machine 200 and knitted component 260 may be enhanced to better illustrate the knitting process.

First standard feeder 204 includes first feeder arm 212 with first dispensing tip 213. First feeder arm 212 is angled to position first dispensing tip 213 in a location that is (a) centered between needles 202 and (b) above an intersection of needle beds 201. Note that needles 202 lay on different planes, which planes are angled relative to each other. That is, needles 202 from needle beds 201 lay on the different planes. Needles 202 each have a first position in which needles 202 are retracted, and a second position, in which needles 202 are extended. In the first position, needles 202 are spaced from the intersection where the planes upon which needle beds 201 lay meet. In the second position, however, needles 202 are extended and pass through the intersection where the planes upon which needle beds 201 meet. That is, needles 202 cross each other when extended to the second position. It should be noted that first dispensing tip 213 second dispensing tip 246, and third dispensing tip 266, are located above the intersection of the planes. In this position, first dispensing tip 213, second dispensing tip 246, and third dispensing tip 266, supply yarn to needles 202 for purposes of knitting, tucking, and floating.

Referring now to FIG. 23, first standard feeder 204 moves along rail 203 and a new course is formed in knitted component 260 from yarn 206. More particularly, needles 202 pulls sections of yarn 206 through the loops of the prior course, thereby forming the new course. Accordingly, courses may be added to knitted component 260 by moving standard feeder 204 along needles 202, thereby permitting needles 202 to manipulate yarn 206 and form additional loops from yarn 206.

Referring now to FIG. 24, an exemplary embodiment, with loops of first yarn 206 form a portion of knitted component 260, is illustrated. However, the top row of yarn is third yarn 226 from third standard feeder 224. As can be seen, third standard feeder 224 moved along rail 203 to supply third yarn 226 to form the row. In another exemplary embodiment, with third standard feeder 224 positioned at the far right of rail 203, second standard feeder 214 may be used to form the top row using second yarn 216.

In the exemplary knitting process depicted in FIG. 22 through FIG. 24, the relative positions of the various feeders on rail 203 may restrict the portions of knitted component 260 that may be formed by each respective feeder. For example, second standard feeder 214 and third standard feeder 224 cannot pass by each other of rail 203 to form portions of knitted component 260. Each of second standard feeder 214 and third standard feeder 224 can traverse the entire length of rail 203. Thus, only one standard feeder need be used to supply a type of yarn different from yarn 206, and either second standard feeder 214 or third standard feeder 224 may suitably be used. Thus, knitted component 260 having only two types of yarn may be formed using only two of the standard feeders. However, a third type of yarn, for example, a yarn of a different type or color from the other two yarns, may be supplied by third standard feeder 224.

The processes and methods for knitting a knitted component described and illustrated herein are exemplary and are not meant to be exhaustive. Therefore, it should be understood that additional knitted components including the features of the embodiments described herein, as well as similar knitted components including the features of the embodiments described herein, as well as similar knitted components not explicitly described herein, may be made using one or more knitting processes substantially similar to the knitting method for knitted component s described herein or in the documents incorporated by reference.

Figure 25:
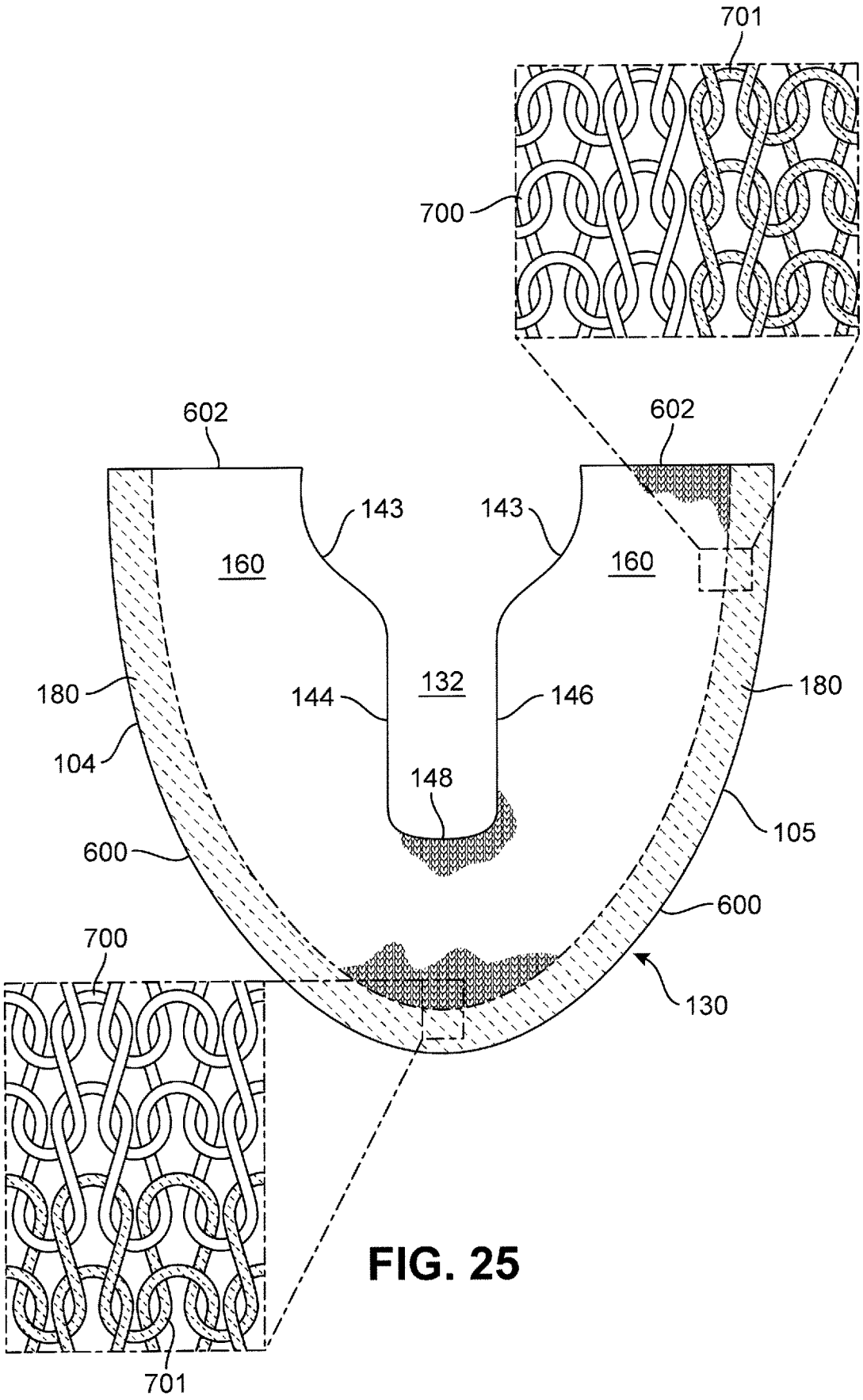
FIG. 25 is a top plan view of an exemplary embodiment of the knitted component with areas of first yarn and areas of second yarn, including enlarged views of exemplary knit structure.

Referring now to FIG. 25, enlarged views of parts of two boundary zones between first portion 160 and second portion 180 are illustrated to show the unitary knit construction of knitted component 130. A boundary zone on knitted component 130 defines the region of knitted component 130 where the yarn used to knit knitted component 130 transitions from one yarn type to another yarn type. For example, knitted component 130 may transition from a first type of yarn 700 forming first portion 160 to a second type of yarn 701 forming second portion 180 at a boundary zone on upper 120. In an exemplary embodiment, first type of yarn 700 transitions from a yarn having durable water repellant properties to second yarn 701 different from yarn 700 at a boundary zone associated with each first portion 160 and second portion 180.

As shown in FIG. 25, at forward forefoot boundary 209 in forefoot region 101 of knitted component 130, knitted component 130 transitions from first portion 160 formed by first yarn having durable water repellant properties 700 to the remaining portion of knitted component 130 formed by second type of yarn 701. In this embodiment, a course of first yarn 700 is joined (e.g., by interlooping) to an adjacent course of second type of yarn 701. That is, a course formed by knitting first yarn 700 is substantially continuous with a course formed by knitting second type of yarn 701. With this configuration, first portion 160 and second portion 180 may be formed of unitary knit construction with knitted component 130.

Similarly, adjacent wales of knitted component 130 may also transition from one type of yarn to a different type of yarn at boundary zones. As shown in FIG. 25, at top medial boundary 210, knitted component 130 transitions from a portion formed by first type of yarn 700 to second portion 180 formed by second yarn 701. In this embodiment, wales of first type of yarn 700 are joined to an adjacent wale of second type of yarn 701. In one embodiment, second portion 180 may be knit using an intarsia knitting technique to transition between yarn types along boundary zones. For example, wales of first type of yarn 700 may joined to adjacent wales of second type of yarn 701 by using intarsia knit construction techniques. With this configuration, first portion 160 and second portion 180 may be formed of unitary knit construction with knitted component 130. Intarsia techniques also are used to form areas such as third portion 190 illustrated in FIG. 16. The first portion, second portion, and third portion may be formed of unitary knit construction with knitted component 130.

Knitted component 130 can be formed from at least one yarn that is manipulated (e.g., with a knitting machine) to form a plurality of intermeshed loops that define a knitted component 130 having a variety of courses and wales. Thus, adjacent areas of knitted component 130 can share at least one common course or at least one common wale. That is, knitted component 130 can have the structure of a knit textile. It will be appreciated that knitted component 130 can be formed via weft knitting operations, warp knitting operations, flat knitting operations, circular knitting operations, or other suitable methods.

Knitted component 130 may incorporate various types and combinations of stitches and yarns. With regard to stitches, the yarn forming knitted component 130 may have one type of stitch in one area of knitted component 130 and another type of stitch in another area of knitted component 130. Depending upon the types and combinations of stitches utilized, areas of knitted component 130 may have a plain knit structure, a mesh knit structure, or a rib knit structure, for example. The different types of stitches may affect the physical properties of knitted component 130, including aesthetics, stretch, thickness, air permeability, and abrasion-resistance of knitted component 130. That is, the different types of stitches may impart different properties to different areas of knitted component 130. With regard to yarns, knitted component 130 may have one type of yarn in one area of knitted component 130 and another type of yarn in another area of knitted component 130.

The type of knit used to make the knitted component may affect water resistance of the upper. The ability of an article of footwear having an upper comprising a knitted component to prevent incursion of water through the upper may relate to the type and tightness of the knit. Tightness of the knit fabric may be expressed as the ratio of the fabric area covered by yarn to the whole area covered. Tighter knitted component will provide greater water resistance then a looser knitted component of the same knit style. Thus, in embodiments of the disclosure, tightness of the knit component is a consideration in establishing the water resistance of the article of footwear.

Although embodiments of the disclosure have been described in detail as providing an upper comprising a single layer, the disclosure also contemplates uppers having plural layers. The plural layers may be fused, double-knit, or otherwise associated with each other. However, the second portion, which may include the "bite line," may be only one layer. In some embodiments of an article of footwear, the bite line may extend about 5 mm from the outer periphery of the first portion and the second portion may extend a substantially similar distance of 5 mm so as to correspond to the location of the bite line. In other embodiments of the disclosure, edges of the second portion may be joined under the sockliner. In that case, the second portion may extend more than about 5 mm from the outer periphery of the first portion.

The exemplary embodiments described herein may assist with saving time in assembly of an article of footwear. Typically, after the upper is attached to a strobel, an operator draws a line to indicate the extent of the bite line to limit where adhesive is to be applied before joining the sole structure to the upper. Any visible markings then may be removed, such as by washing. According to the exemplary embodiments, it may not be necessary to draw, or to later remove, any line because the difference in yarn type between the first portion and the second portion provides a clear indication of the extent of the bite line.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of knitting a knitted component for an upper of an article of footwear, the method comprising:

knitting a first portion of the knitted component with a first yarn, the first yarn having durable water repellant properties;

knitting a second portion of the knitted component with a second yarn, the second yarn being different from the first yarn;

wherein the second portion is disposed along an edge portion of the knitted component and forms an uninterrupted border around the first portion; wherein the first yarn is absent from the second portion;

attaching the second portion to an underfoot portion with water based adhesives; and wherein the first portion is not attached to the underfoot portion by water based adhesives.

2. The method of claim 1 wherein the second portion extends from an outer periphery of the first portion.

3. The method of claim 1, further comprising:

providing a knitting machine having a first feeder that dispenses the first yarn, a second feeder that dispenses the second yarn, and a needle bed that includes a plurality of needles;

moving at least the first feeder along the needle bed to form a first course of a knitted component from the first yarn; and moving the second feeder along the needle bed to form a second course of the knitted component from the second yarn.

4. The method of claim 3, wherein the first course is joined to the second course.

5. The method of claim 1, further comprising selecting the second yarn to be compatible for use with water-based adhesive.

6. The method of claim 3, wherein the knitting machine further comprises a third feeder that dispenses a third yarn different from the first yarn.

7. The method of claim 6, further comprising incorporating the third yarn into at least one of the first and second courses.

8. The method of claim 1 wherein the knitted component including the first portion and the second portion comprises a unitary one-piece structure.

9. The method of claim 1 wherein the one or more knit loops of the first portion are interlooped with one or more knit loops of the second portion to form at least one continuous course.

10. The method of claim 1 wherein a course formed by knitting the first yarn is substantially continuous with a course formed by knitting the second yarn.

11. The method of claim 1 wherein the first yarn having durable water repellant properties transitions to the second yarn different than the first yarn at a boundary zone located between the first portion and the second portion.

12. The method of claim 1 wherein the second portion extends continuously from a lateral side to a medial side of the article of footwear.

13. The method of claim 1 wherein the second portion is located adjacent a biteline of the article of footwear.

14. The method of claim 1 further comprising knitting a third portion formed by a third yarn, wherein the third yarn is different from the first yarn.

15. A method of manufacturing an article of footwear having an upper and a sole structure, the method comprising:

knitting a one-piece knitted component for incorporating into the upper, wherein a first portion of the knitted component is formed by a first yarn, the first yarn having durable water repellant properties, and wherein a second portion of the knitted component is formed by a second yarn, the second yarn being different from the first yarn, and wherein the second portion forms an uninterrupted border around the first portion and wherein the first yarn is absent from the second portion, and attaching the sole structure to the second portion of the knitted component with water based adhesives; and wherein the first portion is not attached to the sole structure by water based adhesives.

16. A method according to claim 15 wherein the second portion further comprises a lateral side, a medial side, and an outer perimeter edge, the method further comprising attaching at least a portion of the outer perimeter edge on the lateral side and at least a portion of the outer perimeter edge on the medial side to each other.

* * * * *